US009808050B2

(12) United States Patent
Ben-Arie

(10) Patent No.: US 9,808,050 B2
(45) Date of Patent: Nov. 7, 2017

(54) LACE RATCHET FASTENING DEVICE

(71) Applicant: Jezekiel Ben-Arie, Carlsbad, CA (US)

(72) Inventor: Jezekiel Ben-Arie, Carlsbad, CA (US)

( * ) Notice: Subject to any disclaimer, the term of this patent is extended or adjusted under 35 U.S.C. 154(b) by 0 days.

(21) Appl. No.: 15/207,517

(22) Filed: Jul. 12, 2016

(65) Prior Publication Data

US 2017/0127763 A1 May 11, 2017

Related U.S. Application Data

(60) Provisional application No. 62/252,511, filed on Nov. 8, 2015.

(51) Int. Cl.
*A43C 7/04* (2006.01)
*A43C 1/00* (2006.01)

(52) U.S. Cl.
CPC . *A43C 7/04* (2013.01); *A43C 1/00* (2013.01)

(58) Field of Classification Search
CPC ..... A43C 1/00; A43C 7/04
See application file for complete search history.

(56) References Cited

U.S. PATENT DOCUMENTS 1,279,043 A * 9/1918 Treadgold ..... A43C 7/04 24/712.6
3,225,402 A * 12/1965 Altman ..... A43C 7/04 24/134 R
4,071,964 A 2/1978 Vogiatzis
4,125,918 A 11/1978 Baumann
4,130,949 A 12/1978 Seidel
4,261,081 A 4/1981 Lott
4,458,373 A 7/1984 Maslow
4,507,878 A 4/1985 Semouha
4,616,432 A 10/1986 Bunch
4,648,159 A 3/1987 Dougherty
4,991,273 A 2/1991 Huttle
5,001,847 A 3/1991 Waters
5,097,573 A 3/1992 Gimeno
5,109,581 A 5/1992 Gould
5,119,539 A 6/1992 Curry
5,177,882 A 1/1993 Berger
5,203,053 A 4/1993 Rudd
5,230,171 A 7/1993 Cardaropoli
5,293,669 A 3/1994 Sampson
5,293,675 A 3/1994 Shai
5,295,315 A 3/1994 Osawa
(Continued)

*Primary Examiner* — David Upchurch

(57) ABSTRACT

Various configurations of Lace Ratchet Device (LRD) enables easy lace fastening and release. The LRD has two positions: "active" and "inactive". In the active position the device works as a lace ratchet i.e. allowing the lace to be pulled forwards but blocks any lace motion backwards. After fastening the lace remains fastened until the LRD is switched into inactive position by pressing a lever. Each LRD has a turning gate with front end with sharp edge, rotatably installed in a channel. A preloaded helical torque spring keeps the LRD in active position when the lever is not pressed. Unlike prevalent lace fasteners with serrated surfaces, which cause accelerated lace wear, LRD's smooth front edge side and channel surfaces minimize lace wear. Parallel and triangular configurations of LRD pairs facilitates lace fastening of footwear, serving as "Ratchet Buckles". Single LRDs can be used for fastening of garments and other objects.

20 Claims, 30 Drawing Sheets

(56) References Cited

U.S. PATENT DOCUMENTS

| | | | | |
|---|---|---|---|---|
| 5,335,401 | A | 8/1994 | Hanson | |
| 5,467,511 | A | 11/1995 | Kubo | |
| 5,477,593 | A | 12/1995 | Leick | |
| 5,572,774 | A | 11/1996 | Duran | |
| 5,572,777 | A | 11/1996 | Shelton | |
| 6,076,241 | A | 6/2000 | Borel | |
| 6,094,787 | A | 8/2000 | Chang | |
| 6,192,241 | B1 | 2/2001 | Yu | |
| 6,192,559 | B1 | 2/2001 | Munsell | |
| 6,282,817 | B1 | 9/2001 | Curet | |
| 6,334,240 | B1 | 1/2002 | Li | |
| 6,339,867 | B1 | 1/2002 | Azam | |
| 6,438,871 | B1 | 8/2002 | Culverwell | |
| 6,588,079 | B1 | 7/2003 | Manzano | |
| 6,622,358 | B1 | 9/2003 | Christy | |
| 6,729,000 | B1 | 5/2004 | Liu | |
| 6,735,829 | B2 | 5/2004 | Hsu | |
| 6,938,308 | B2 | 9/2005 | Funk | |
| 7,082,701 | B2 | 8/2006 | Dalgaard | |
| 7,152,285 | B2 | 12/2006 | Liao | |
| 7,313,849 | B2 | 1/2008 | Liu | |
| 7,320,161 | B2 | 1/2008 | Taylor | |
| 7,360,282 | B2 | 4/2008 | Borsoi | |
| 7,591,050 | B2 | 9/2009 | Hammerslag | |
| 7,681,289 | B2 | 3/2010 | Liu | |
| 8,046,937 | B2 | 11/2011 | Beers | |
| 8,141,273 | B2 | 3/2012 | Stramare | |
| 8,230,560 | B2 | 7/2012 | Luzlbauer | |
| 8,231,074 | B2 | 7/2012 | Hu | |
| 8,332,994 | B2 * | 12/2012 | Lin | A43C 1/00 24/712.5 |
| 8,371,004 | B2 | 2/2013 | Huber | |
| 8,381,362 | B2 | 2/2013 | Hammerslag | |
| 9,185,948 | B2 | 11/2015 | Ben-Arie | |
| 2002/0002781 | A1 | 1/2002 | Bouirer | |
| 2002/0189056 | A1 * | 12/2002 | Gallina | A44B 11/12 24/68 R |
| 2003/0070269 | A1 * | 4/2003 | Chung | A43C 3/00 24/714.6 |
| 2003/0226284 | A1 | 12/2003 | Grande | |
| 2004/0148741 | A1 * | 8/2004 | Hsiao | A43C 11/1406 24/68 SK |
| 2004/0226189 | A1 * | 11/2004 | Semitka | A43C 3/00 36/50.5 |
| 2005/0005477 | A1 | 1/2005 | Borsoi | |
| 2006/0213085 | A1 | 9/2006 | Azam | |
| 2007/0169380 | A1 | 7/2007 | Borsoi | |
| 2008/0250618 | A1 | 10/2008 | Stramare | |
| 2009/0172929 | A1 | 7/2009 | Hwang | |
| 2010/0115744 | A1 | 5/2010 | Fong | |
| 2011/0094072 | A1 | 4/2011 | Lin | |
| 2013/0160256 | A1 * | 6/2013 | Waldman | A43C 7/04 24/712.6 |
| 2015/0216264 | A1 * | 8/2015 | Kim | A43C 7/00 24/712.7 |

* cited by examiner

LACE RATCHET FASTENING DEVICE

CROSS-REFERENCE TO RELATED APPLICATIONS

This application claims the benefit of provisional patent application Ser. No. 62/252,511, Filed: Nov. 8, 2015.

FEDERALLY SPONSORED RESEARCH

Not Applicable

SEQUENCE LISTING OR PROGRAM

Not Applicable

FIELD OF THE INVENTION

The invention is related to devices for fastening and keeping fastened laces, chords, ropes, strings and alike.

BACKGROUND OF THE INVENTION—PRIOR ART

Many devices were invented for shoe lace tightening. The most commercially successful is U.S. Pat. No. 6,339,867 by Azam which is widely used in fastening laces of skiing and skates boots. The tightening principle is a spring loaded gear wheel which can move in wedge shaped passage which widens forwards and narrows backwards. The laces pass through that passage and can be fastened by pulling the laces forwards which in turn pulls forwards the gear wheel towards the wider part of the passage where the laces are free to move. When the pulling stops the laces pull the gear wheel backwards, which narrows the passage and blocks the laces' backwards motion. The laces can be released by pulling the gearwheel forwards with a knob. There are few noticeable disadvantages to this popular invention. The device must be installed on heavy-solid footwear which eliminates its use with regular shoes and the user must constantly pull the knob to keep the releasing. In addition, the teeth of gearwheel and opposite teeth cause severe lace wear. Similar approach is taken in U.S. Pat. No. 7,360,282 by Borsoi and in U.S. Pat. No. 8,141,273 by Stramare. The lace buckle device described in U.S. Pat. No. 6,334,240 by Li is used widely in coat laces. It has a lace passage controlled by a spring loaded piston that blocks lace motion when the spring is released. Except for the similar name there is no similarity to our invention. This buckle controls only one lace and does not have a ratchet operation at all. When the user wants to release or fasten the lace the user has to press the spring loaded piston, release the lace and pull at the same time. When the spring is released, the buckle returns to b the lace. Similar devices are sold as "shoe buckles" for fastening shoe laces. The main disadvantage of such shoe buckles is that they do not have a ratcheting operation, which enables one to fasten the laces just by pulling. The shoe buckles require one to fasten the laces with one hand while keeping the buckle in position with the other hand and then switching the buckle into position. This results in cumbersome and inefficient fastening.

In U.S. Pat. No. 6,729,000 Liu uses for lace tightening a teethed rotating bar. In U.S. Pat. No. 6,076,241 by Borel and in several others such as in U.S. Pat. No. 6,622,358 to Christy and in U.S. Pat. No. 6,192,241 by Yu et al. use fastening devices which are based on pipes or channels which have diagonal teeth to block reverse motion of the lace. The pipes are installed on the shoes in different locations.

In U.S. Pat. No. 8,371,004 Huber teaches a lace mechanism. Huber's mechanism employs a pair of spring loaded pivoted arms which have sets of sharp teeth that when pressed against the laces block their motion in both directions. Thus, Huber's mechanism is not a lace ratchet mechanism because it does not allow further lace tightening once it is. In its state, the laces are released in both directions simply by pressing the arms of Huber's mechanism. Huber's mechanism is impractical because the sharp teeth tend to cause a lot of lace wear when the laces are fastened before. Huber's mechanism structure is complex and expensive to manufacture. In addition, similar to the lace buckle, the user needs to fasten both laces with one hand while pressing the arms with the second hand to keep the mechanism in position. In U.S. Pat. No. 8,332,994 Jih-Liang Lin teaches a shoe lace fastener which fasten the lace using jagged arm on top and jagged base on bottom. The device structure includes many complex parts and is expensive to manufacture. Such a structure also is impractical because it will wear the lace very quickly. In U.S. Pat. No. 8,381,362 to Hammerslag et al. teaches Real based closure system. U.S. Pat. No. 8,332,994 to Lin teaches Shoelace with shoelace fastener. U.S. Pat. No. 8,141,273 to Stramare et al. describes Shoes with directional conditioning device for laces. U.S. Pat. No. 8,231,074 to Hu et al. describes Lace winding device for shoes. U.S. Pat. No. 8,230,560 to Luzlbauer teaches Fastening system for shoes.

U.S. Pat. No. 9,185,948 to Ben-Arie describes a Buckle Lace Fastening Device (BLFD) which also enables lace ratcheting. However, the BLFD is using resilient gates which do not rotate but bend. In addition, the mechanism of the BLFD, which is based on rotating the gripping wall is entirely different from the mechanism of the current invention.

U.S. Pat. No. 8,046,937 to Beers et al. describes an Automatic lacing system. U.S. Pat. No. 7,681,289 to Liu describes a Fastener for fasting together two lace systems. U.S. Pat. No. 7,591,050 to Hammerslag describes a Footwear lacing system. U.S. Pat. No. 7,320,161 to Taylor describes a Lace tying device. U.S. Pat. No. 7,313,849 to Liu describes a Fastener for lace. U.S. Pat. No. 7,152,285 to Liao describes a Shoe lace fastening device. U.S. Pat. No. 7,082,701 to Dalgaard describes Footwear variable tension lacing systems. U.S. Pat. No. 6,938,308 Funk describes a lace securing and adjusting device. U.S. Pat. No. 6,735,829 Hsu describes a U shaped lace buckle. In U.S. Pat. No. 6,588,079 to Manzano describes a Shoelace fastening assembly. U.S. Pat. No. 6,438,871 to Culverwell describes Footwear fastening. U.S. Pat. No. 6,192,559 to Munsell Jr. describes a Shoelace fastening apparatus. U.S. Pat. No. 6,094,787 to Chang describes a Fastening device. U.S. Pat. No. 5,572,777 to Shelton describes a Shoelace tightening device. U.S. Pat. No. 5,572,774 to Duren teaches a Shoe fastening attached device. U.S. Pat. No. 5,467,511 to Kubo describes a Shoelace fastening device. U.S. Pat. No. 5,335,401 to Hanson teaches a Shoelace tightening and device. U.S. Pat. No. 5,295,315 to Osawa et al. describes a Shoe fastening device and plate shaped member thereof. U.S. Pat. No. 5,293,675 to Shai describes a Fastener for shoelace. U.S. Pat. No. 5,293,669 to Sampson teaches a Multiuse fastener system. U.S. Pat. No. 5,230,171 to Cardaropoli teaches a Shoe fastener. U.S. Pat. No. 5,203,053 to Rudd teaches a Shoe fastening device. U.S. Pat. No. 5,177,882 to Berger teaches a Shoe with central fastener. U.S. Pat. No. 5,119,539 to Curry teaches a Lace fastener. U.S. Pat. No. 5,109,581 to Gould teaches a Device and method for securing a shoe. U.S. Pat. No. 4,991,273 to Huttle teaches Shoe lace fastening. U.S. Pat. No. 4,648,159 to Dougherty teaches a Fastener for lace or rope or the like. U.S. Pat. No. 4,616,432 to Bunch et al. teaches a Shoe upper with lateral fastening arrangement. U.S. Pat. No. 4,507,878 to Semouha teaches a Fastener mechanism. U.S. Pat. No. 4,458,373 to Maslow teaches Laced shoe and method for tying shoelaces. U.S. Pat. No. 4,261,081 to Lott teaches a Shoelace tightener. U.S. Pat. No. 4,130,949 to Seidel teaches Fastening means for sports shoes. U.S. Pat. No. 4,125,918 to Baumann teaches a Fastener for lace shoes. U.S. Pat. No. 4,071,964 to Vogiatzis teaches a Footwear fastening system. U.S. Pat. No. 5,097,573 to Gimeno teaches Fastening Device for Lace Up Shoes. U.S. Pat. No. 5,001,847 to Waters teaches a Lace Fastener. U.S. Pat. No. 5,477,593 to Leick teaches a Lace Device. U.S. Pat. No. 6,282,817 to Curet teaches an Apparatus and Method for Lacing.

US Patent Applications

In US 2011/0094072 to Lin describes a Shoelace with Shoelace Fastener. In US 2010/0115744 to Fong describes a Lace Fastener. In US 2009/0172929 to Huang describes a Device for tying Shoe laces. In US 2008/0250618 to Stramare describes a Shoe with Directional Conditioning Device for lace or the like. In US 2007/0169380 to Borsoi teaches a Device for B Flexible Strands. In US 2006/0213085 to Azam teaches an Article for Footware with Linkage Tightening Device. In US 2005/0005477 to Borsoi teaches a Lace B Device. In US 2003/0226284 to Grande teaches a Lacing System For Skates. In US 2002/0002781 to Bourier teaches a Lace Tightening Device Having a Pocket for Storing a B Element.

In conclusion, all the above inventions do not propose a Lace Fastening Device which combines all of the following desired properties:

1. The device enables users to fasten regular laces by a ratchet operation, i.e. the user has just to pull the lace and the lace remains fully fastened after the pulling stops.
2. The lace can be released easily and quickly by the user.
3. The device has a simple structure, which is suited for low cost manufacturing.
4. Repeated use of the device causes minimal lace wear.
5. The device can fasten any standard lace and can be easily installed on footwear, garments or other objects.

BRIEF SUMMARY OF THE INVENTION

The invention includes various lace ratcheting configurations of a basic lace ratcheting device. These configurations facilitate easy fastening and keeping fastened of: laces, ropes, strings and alike. The basic Lace Ratcheting Device (LRD) is small in dimensions and can be installed on shoes or on other items which need fastening of laces, ropes, strings and alike. The LRD can be used to fasten laces simply by inserting the laces into LRDs and pulling them. The LRD has a ratcheting mechanism with two positions: "active" and "inactive". In the active position the device works as a lace ratchet i.e. allowing the lace to be pulled forwards but b any lace motion backwards. After the user has fastened the laces they remain fastened until the mechanism is switched into an inactive position. Each LRD has a channel for fastening one lace. A turning gate is rotatably installed on an axle in the channel. The axle is centered at the turning gate's axis of rotation. The turning gate has a lever attached to its rear end and also a preloaded helical torque spring with a bias which tends to turn the gate in backwards direction i.e. towards an active position. Thus, the regular position of the turning gate is in active position and it is switched into inactive position only when the user applies manual pressure on the lever, which exceeds the bias. The turning gate has a front end which has a single sharp edge with a smooth side. The lace passes through a gap between the front end of the turning gate and the channel's gripping wall situated opposite to the front end of the turning gate. The gap width is controlled by a ratcheting mechanism operated by the lever.

When the ratcheting mechanism is in active position, the gap is narrowed such that the turning gate is squeezing the lace in the channel with its sharp edge and acts as a lace ratchet. It means that the turning gate allows forwards fastening motion of the lace but blocks any lace motion in backwards direction. In order to have a ratchet operation, the turning gate is installed in a forwards leaning diagonal position in the channel such that its front end is closer to the gripping wall then its axis of rotation. Also, in a forwards leaning diagonal position, the turning gate's front end is closer to the channel's exit than the turning gate's axis of rotation. The ratchet operation of the gate stems from the forward leaning diagonal position of the turning gate, which allows forwards lace motion when the lace is moved forwards. Moving forwards the lace which is squeezed in the gap, drags the turning gate's front end forwards because of the friction force between the lace and the front end squeezing it. Due to the forwards leaning diagonal position of the turning gate, when its front end is moved forwards it also moves laterally inwards i.e. away from its gripping wall, thus increasing the width of the gap between the front end and its gripping wall and enabling even easier forwards motion of the lace.

On the other hand, if the lace moves backwards it also drags the turning gate's front end backwards since the front end is squeezing the lace and has a mutual friction force with the lace. Due to the forwards leaning diagonal position of the gate, the motion backwards of the front end has also a lateral outwards component which moves the front end towards the gripping wall thus further narrowing the gap and b further backwards lace motion. Thus, in an active position the gate acts as a lace ratchet i.e. allows lace forwards motion but blocks lace's backwards motion. When the ratcheting mechanism is switched into inactive position the gap is widened more than the lace's width and the lace is entirely released because it can move freely forwards or backwards in the channel. The user can easily switch the ratcheting mechanism from active to inactive position simply by manually pressing the lever, which is attached to the rear end of the turning gate. If the manual pressure is greater than the torque spring's bias, the gate turns forwards and increases the gap's width, thus inactivating the LRD. When the manual pressure ceases the preloaded torque spring rotates the gate backwards into an active position. The LRD can be manufactured at low cost because it has a simple structure with only few parts.

The LRD's structure is different from other lace fastening devices in few important aspects. Primarily, the LRD enables a lace ratcheting operation which causes only minimal wear of the lace since it employs in the channel a novel structure with a diagonally forwards leaning rotating gate with a single sharp front end which has a smooth side. When the lace is moved forwards, the sharp edge at the front end of the turning gate rotates forwards this also turns the smooth side of the sharp edge to be approximately parallel with the lace and the lace is sliding on the smooth side of the sharp edge—which does not wear the lace. At the same time, the forwards rotation also widens the gap and reduces lace friction and wear while the lace is moved forwards. Since the lace is b from moving backwards, there is no lace wear in the backwards motion as well. In addition, the LRD's gripping wall is made with smooth surface to minimize lace wear when it moves in the gap as well. In contrast, other lace fastening devices employ serrated surfaces with sharp teeth structures to block lace movement in their position. However, sharp teeth structures cause significant lace wear even when they are in state since their teeth remain pointed at the lace and the lace still touches them as it moves even in a wider gap.

A pair of LRDs in a parallel configuration can be used as a shoe "Ratchet Buckle", which is not attached to the shoe but enables fastening two laces' ends of each shoe. The LRDs are attached to one another in a parallel configuration of their channels by attaching the LRDs at their gripping walls. Such a shoe buckle, which is not attached to the shoe, enables easy fastening and releasing of the shoe laces. The two gate levers of the turning gates protrude from the channels' top walls, on the two sides of LRD's parallel configuration. This enables the user to unlock both LRDs easily by pressing the levers with two fingers of one hand. To eliminate the protruding gate levers, two LRDs can be used as a "Ratchet Buckle" also in a triangular configuration. In the triangular configuration, the two gripping walls form the two sides of a triangle and the two levers, which protrude from the top walls are facing one another at the triangle's center. The two channels are hinged to a small connecting plate and can turn one LRD with respect to the other LRD. The user can unlock both LRDs easily by pressing on the gripping walls on both sides of the triangular configuration. This causes the channels to rotate one towards the other and at the same time to press the gate levers which are facing one another. The triangular configuration has the advantage that it has more elegant look since it does not have protruding gate levers.

Both of the "Ratchet Buckle" structures of the parallel configuration and triangular configuration of two LRDs is designed to lie flat on top of the shoe when the laces are fastened. Each of the channels at the entry opening has a recess at the lower side wall. Each of the channels at entry opening also has a rear segment of the lower side wall next to and behind the recess. The laces are inserted into the channel via the recesses. When the lace is fastened on the shoe, the lace applies a downwards force on the recess. The downwards force is countered by a reaction upwards force applied on the rear segment by the shoe. The downwards force and the reaction upwards force create a moment of force which tends to rotate the LRD towards the shoe. Hence, the moment of force keeps the LRD flat on the shoe.

In another lacing configuration, two single LRDs can be attached to the two sides of each shoe for two lace fastening. A single LRD can also be used to fasten laces of trousers or coats simply by tying one lace end to the LRD and using the LRD to fasten the other lace's end. All the LRD configurations described above can be implemented by LRDs with helical torque springs which have rear supports of one of their ends. In addition, all the LRD configurations described above can be implemented by LRDs with helical torque springs which have front supports of one of their ends.

The LRD has many advantages over previous devices primarily due to its efficient and easy fastening operation by a ratchet mechanism which requires the user just to pull the lace. Once the lace is pulled, it remains fastened until the ratcheting mechanism is switched from active position into inactive position whereby it disables the ratchet mechanism and releases the lace. Another advantage of the LRD is the ability to switch the ratcheting mechanisms of two LRDs in parallel configuration and also in triangular configuration from active position into inactive position simply by squeezing the two opposite gate levers using just two fingers of one hand. Additional advantage over all the other lace ratchets is that is does not block the lace using jagged surfaces. Handling laces with jagged surfaces, which have sharp teeth, as all other lace fasteners do, results is fast wear of the laces. The diagonal orientation of the sharp edges at the front ends of the turning gates in the LRDs, cause very little lace wear because each sharp edge has a smooth side on which the lace can slide when it is fastened. The LRD was worn and tested by the Applicant for a long time on various shoes without any noticeable lace wear.

BRIEF DESCRIPTION OF THE DRAWINGS

FIGS. 1 and 2 describe a LRD embodiment with torque spring which has a rear support.

FIGS. 23 and 24 show the lace sliding on the smooth sides of the sharp edges of gates of LRDs with rear and front spring support respectively.

DETAILED DESCRIPTION OF THE DRAWINGS

Figure 1:
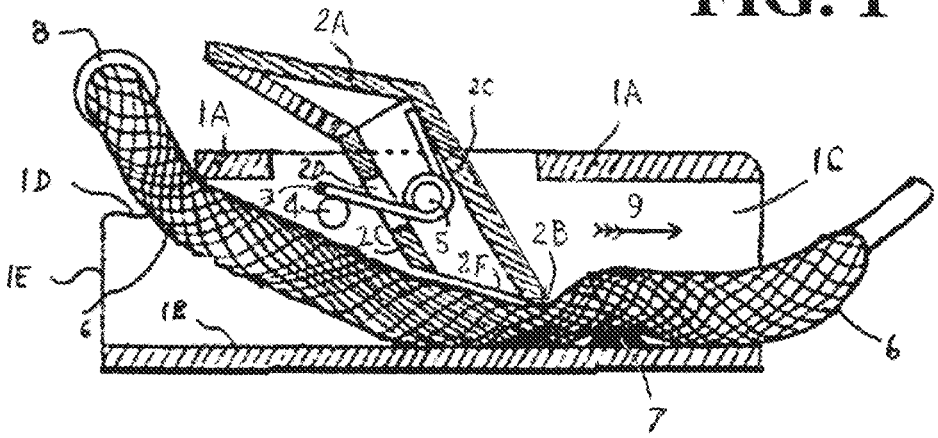
FIGS. 1 and 2 illustrate projections of cross sections of an embodiment of a LRD with its ratcheting mechanism in active and inactive positions respectively.
Figure 2:
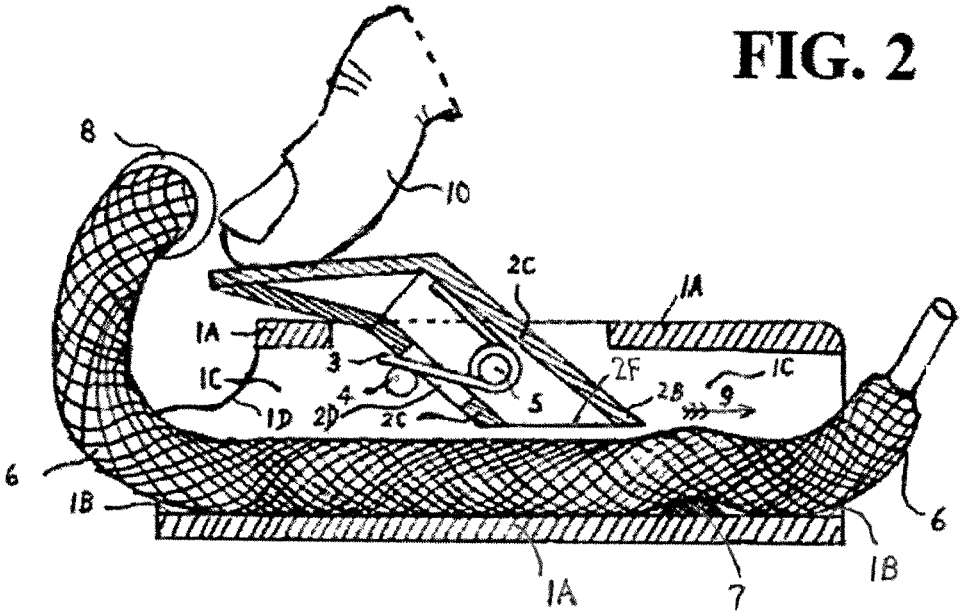

FIGS. 1 and 2 illustrate projections of cross sections of an embodiment of a rear supported spring LRD with ratcheting mechanisms in active and inactive positions respectively. The LRD's housing 1A provides the walls for the channel 1C which houses the turning Gate 2C which is installed on an axle 5. The channel 1C also houses the lace 6. The turning gate 2C is mounted on axle 5. Also mounted on the axle is a helical torque spring 3 which has a bias that tends to rotate the turning gate 1C in backwards turning direction (clockwise direction). Backwards turning moves the turning gate 2C into an active position of the ratcheting mechanism. The turning Gate 2C in FIG. 1 which is in an active position squeezes the lace 6 in the Gap between the Gate's sharp edge at the front end 2B and the channel's gripping wall 1B. In FIG. 2 the turning Gate 2C is in inactive position because the Gate 2C is turned in counterclockwise direction (also called forwards turning) and the Gap between the Gate's sharp edge at the front end 2B and its gripping wall 1B is wider than the width of lace 6. As shown in FIG. 2, the user has been switching the ratcheting mechanism into an inactive position. This is being done by turning forwards the turning Gate 2C into an inactive position by pressing downwards on the lever 2A with the user's finger 10. To enable the inactivation operation, the lever 2A protrudes from the channel's 1C top wall 1A. As can be observed in FIGS. 1, 2 the turning Gate 2C is in a forwards leaning diagonal orientation in the channel 1C such that its front end 2B is closer to the gripping wall 1B then its axis of rotation centered at axle 5. Also, in a forward leaning diagonal position, the turning gate's sharp edge at front end 2B is closer to the channel's exit than the turning gate's axis of rotation centered at axle 5. The forward direction arrow 9 is pointed towards the channel's exit. The ratchet operation of the turning gate 2C stems from the forward leaning diagonal position of the turning gate, which allows forward lace 6 motion (to the right) when the lace is moved forwards and at the same time, drags the gate's front end 2B forwards. Because of the diagonal position of the gate 2C, when its front end 2B moves forwards (i.e. in the arrow 9 direction) it also moves laterally inwards i.e. away from its gripping wall 1B, thus increasing the width of the gap between the front end 2B and its gripping wall 1B and enabling even easier forward motion of the lace. The LRD structure is designed to minimize lace wear. For this reason the gripping wall 1B surface and the smooth side 2F of the sharp edge at the front end 2B are smoothed. When the lace 6 is being fastened i.e. moved in forwards direction and causing the turning gate to turn forwards, the turning gate turns the sharp edge at the front end 1B away from the lace and the lace slides on the smooth side 2F of the sharp edge at the front end 2B and on the smoothed gripping wall 1B with minimal wear.

On the other hand, if the lace moves backwards (i.e. opposite to the arrow 9 direction) it also drags the gate's front end 2B backwards. Due to the diagonal position of the gate, the motion backwards has also a lateral outwards component which moves the front end 2B towards the gripping wall 1B thus further narrowing the gap and b further backwards lace motion. Thus, in an active position the gate acts as a lace ratchet i.e. allows lace forwards motion but blocks backwards motion. When the ratcheting mechanism is switched into inactive position the gap is widened enough such that the lace is entirely released because it can move freely forwards or backwards in the channel. The ratcheting mechanism can be switched from active to inactive position by manually pressing at lever 2A attached to each gate and rotating the gate forwards (i.e. in counterclockwise direction in FIGS. 1 and 2). The manual pressure in FIG. 2 is applied by the user's finger 10. When the manual pressure ceases the preloaded spring 3 rotates the gate 2C backwards (i.e. in clockwise direction in FIGS. 1 and 2) into an active position.

In the Gate's 2C forward leaning diagonal orientation, pulling the lace 6 in forwards direction (to the right) which is denoted by the arrow 9, causes the Gate's front end 2B to move in a combined forwards and laterally inwards motion (i.e. moving upwards and away from the gripping wall 1B) motion. The lateral inwards movement increases the width of the Gap and also turns the sharp edge at the front end 2B away from the lace 6, thus allowing the lace to move forwards more easily with less friction and wear because it slides on the smooth side 2F and on the smoothed gripping wall 1B. On the other hand, pulling the lace 6 in backwards direction (to the left) which is opposite to the arrow 9, causes the turning Gate's front end 2B to move in a combined backwards and laterally outwards motion (i.e. moving towards the gripping wall 1B). The laterally outwards movement reduces the width of the Gap, thus squeezing the lace even harder therefore preventing the lace to move further backwards. The bulge 7 which is installed on the gripping wall 1B, increases the b force of the turning Gate 2C by forcing the lace to bend when the front end 2B squeezes it. Both the gripping wall 1B and the bulge 7 have smooth surfaces to minimize the wear of the lace passing in the gap.

The helical torque spring 3 which is installed on the axle 5 is preloaded and has a bias which constantly pushes the turning Gate 1C to turn backwards (i.e. in clockwise direction in FIG. 1). Thus, the spring 3 keeps the LRD in an active position when the user is not pressing on the lever 2A. To switch the Gate's ratcheting mechanism into an inactive position, the user's finger 10 has to press the Gate's lever 2A downwards overcoming the spring's 3 bias. The helical torque spring 3 has two wire ends one wire end exits the turning gate via opening 2D and is supported by pin 4. The pin 4 was attached to the channel 1C to support the spring's 3 wire end, i.e. to provide rear support to the spring. The other wire end of the spring is supported by the turning gate's wall. In FIG. 1 the lace 6 exits the shoe's eyelet 8 and enters the channel 1C. The lace 6 in FIG. 1 is fastened and enters the channel 1C via the recess 1D in the lower side wall. The downwards pressure of the fastened lace 6 on the recess 1D in the lower side wall and the upwards reaction pressure of the shoe on the channel's rear segment 1E of the lower side wall create a moment force which forces the LRD to rotate downwards, thus keeping the LRD flat on the shoe. The lever 2A protrudes from an opening in the top wall 1A.

Figure 3:
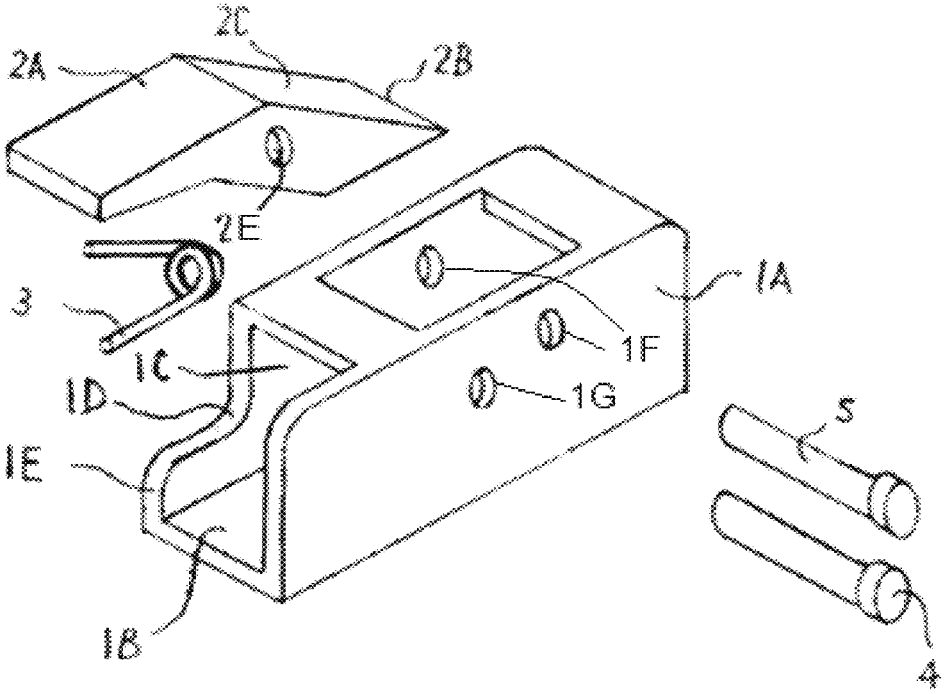
FIG. 3 shows a blow up 3D isometric drawing of the parts of a rear spring support embodiment of a disassembled LRD. The parts' orientations correspond to their actual orientations in the assembled LRD.

FIG. 3 shows a blow up 3D isometric drawing of the parts of an embodiment of a disassembled LRD with rear spring support. The parts' orientations correspond to their actual orientations in the assembled LRD. Pin 5 serves as an axle to the turning Gate 2C. The turning gate 2C is shown with its front end 2B and its lever 2A. Hole 2E which serves as a bearing for axle 5 is not denoted in FIGS. 1 and 2 to prevent overcrowding. Opening 2D which serves as a passage for the spring's 3 arm in the rotating gate, is shown only in FIGS. 1, 2, 7 due to its rear side location, which is not shown in FIG. 3. Pin 4, which is riveted to the housing 1A in holes 1G serves as a rear support for the spring 3. The axle 5 is riveted to the LRD housing 1A at holes 1F.

Figure 4:
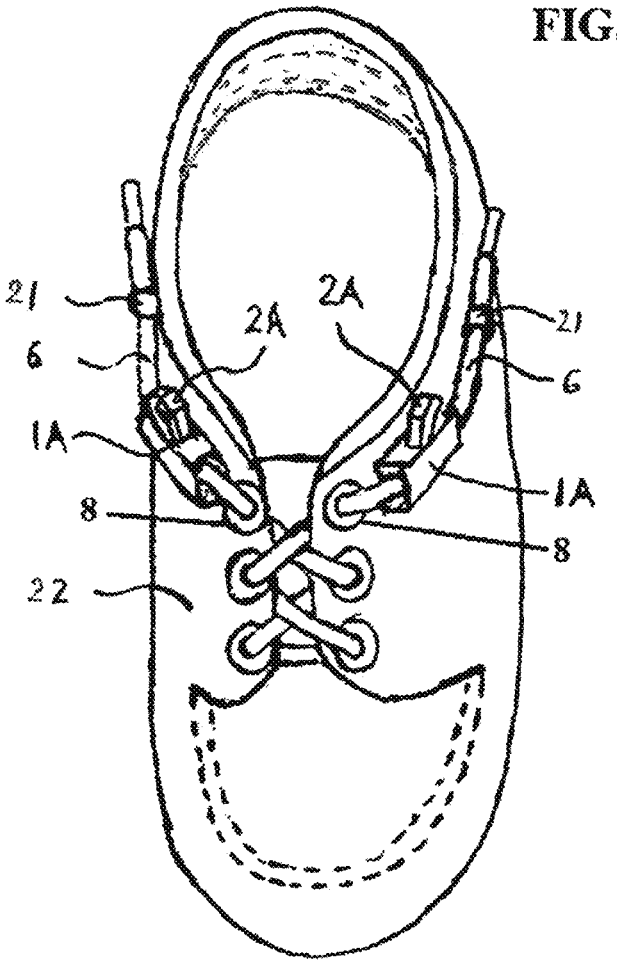
FIG. 4 describes two rear spring support embodiments of a LRD, which are installed on two sides of a shoe for lace fastening.

FIG. 4 describes two LRDs 1A which are installed on a shoe's top 22. The laces 6 which exit the eyelets 8, enter the LRDs 1A and are fastened backwards. The hooks 21 serve as lace end holders to prevent lace dangling.

Figure 5:
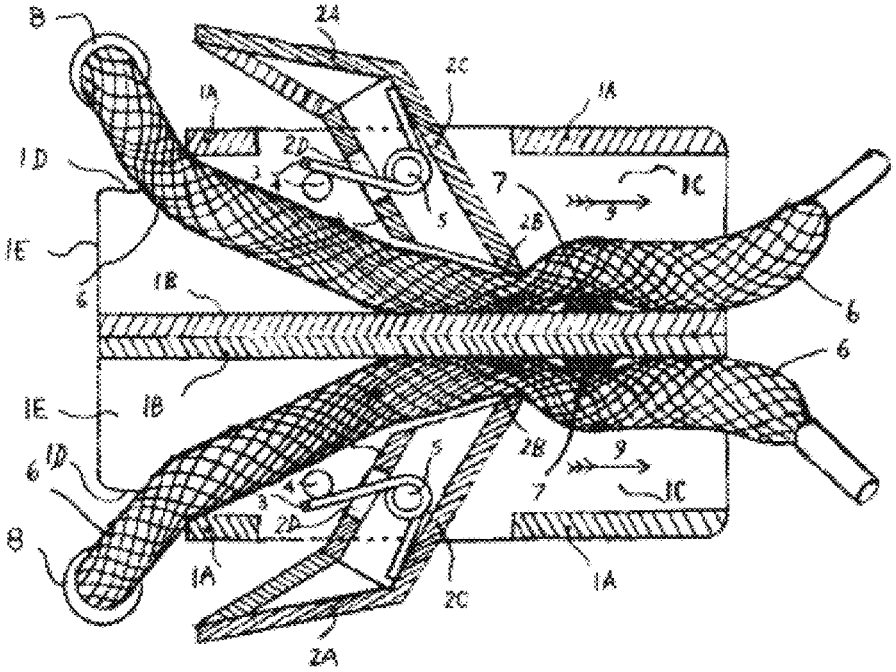
FIG. 5 shows a cross section projection drawing of a pair of rear spring support LRDs which are attached to one another in a parallel configuration as a "Ratchet Buckle". The ratcheting mechanisms of the LRDs in FIG. 5 are in active position.
Figure 6:
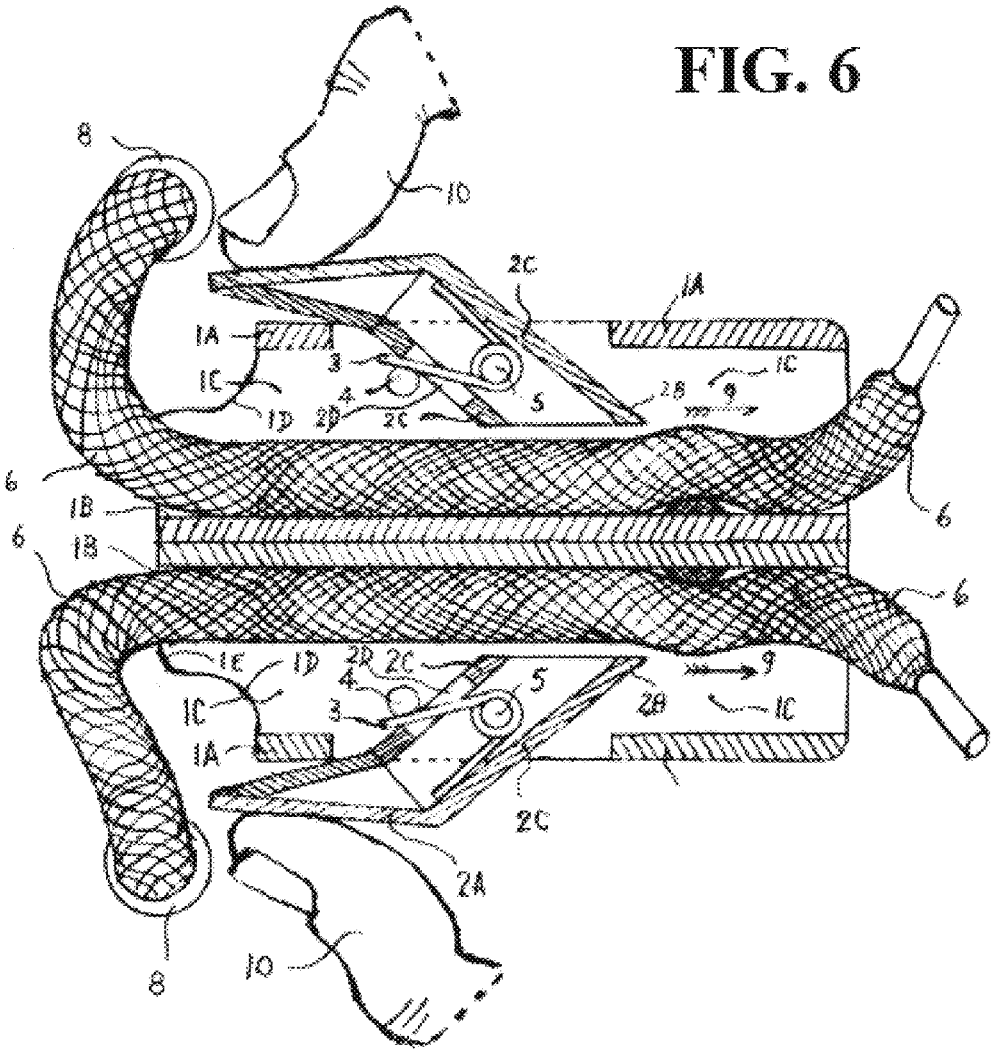
FIG. 6 shows a cross section projection drawing of a pair of rear spring support LRDs which are attached to one another in a parallel configuration as a "Ratchet Buckle". The ratcheting mechanisms of the LRDs in FIG. 6 are in inactive position.

FIG. 5 depicts a cross section drawing of a pair of rear support LRDs which are attached to one another in a parallel configuration. The ratcheting mechanisms of these LRDs are in active positions and the laces 6 are fastened. The LRDs' housing 1A provides the walls for the channels 1C which house the turning Gates 2C which are installed on axles 5. Each of the channels 1C also house a lace 6. The turning Gates 2C in FIG. 5 which are in active positions squeeze the laces 6 in the Gaps between the Gates' front ends 2B and the channels' gripping walls 1B. In FIG. 6 the turning Gates 2C are in inactive positions because the Gates 2C are rotated in forwards turning direction and the Gap between the Gates' sharp edges at their front ends 2B and their gripping walls 1B is wider than the widths of laces 6. As shown in FIG. 6, the user has been switching the ratcheting mechanism into inactive positions by applying manual pressure on the levers 2A by fingers 10. This is being done by rotating forwards the turning Gates 2C into inactive positions by pressing on the levers 2A with the users' fingers 10. As can be observed in FIG. 5, the turning Gates 2C are in a forward leaning diagonal orientations. In these orientations pulling the laces 6 in forwards direction (to the right) which is denoted by the arrows 9, causes the Gates' front end to move in a combined forwards and laterally inwards motion (i.e. moving away from their gripping walls 1B) motion. The lateral inwards movements increase the widths of the Gaps and also turns the sharp edges at their front ends 2B away from the laces 6, thus allowing the laces to move forwards more easily with less friction and wear. On the other hand, pulling the laces 6 in backwards directions (to the left) which is opposite to the arrows 9, causes the turning Gates' front ends to move in a combined backwards and laterally outwards motions (i.e. moving towards the gripping walls 1B). The laterally outwards movements reduce the widths of the Gaps, thus squeezing the laces even harder therefore preventing the laces to move further backwards. The bulges 7 which are installed on the gripping walls 1B, increase the breaking force of the turning Gates 2C even further by forcing the laces to bend when the front ends 2B squeezes them. Both the gripping walls 1B and the bulges 7 have smooth surfaces to minimize the wear of the lace passing in the gap.

In FIGS. 5 and 6 the helical torque springs 3 which are installed on the axles 5 are preloaded and have a bias which constantly pushes the turning Gates 1C to turn backwards. Thus, the springs 3 keep the LRDs in an active position when the user is not pressing on the gate levers 2A. To switch the Gates' ratcheting mechanisms into inactive positions, the user 10 has to press the levers 2A (which protrude from the channels' top walls on both sides of the parallel configuration) overcoming the springs' 3 biases—as shown in FIG. 6. The pins 4 were placed to support the springs' 3 first wire ends and provide rear spring supports. The second wire ends of the springs is supported by the turning gates' walls. In FIG. 5 the laces 6 exit the shoe's eyelets 8 and enter the channels 1C. The laces 6 in FIG. 5 are fastened and enter the channels 1C via the recesses 1D in the lower side walls which are situated at the lower sides walls of the entrances of the channels 1C. The downwards pressure of the fastened laces 6 on the recesses 1D create as a reaction an equal counter upwards pressure of the shoe on the channels' entrance rear segment 1E of the lower side wall next to and behind the recesses 1D. The downwards pressure coupled with the upwards pressure generate a rotating moment of force which tends to press the lower side walls of the LRDs parallel configuration against the top part of the shoe. Whereby, keeping the LRDs parallel configuration pressed flat on top of the shoe.

Figure 7:
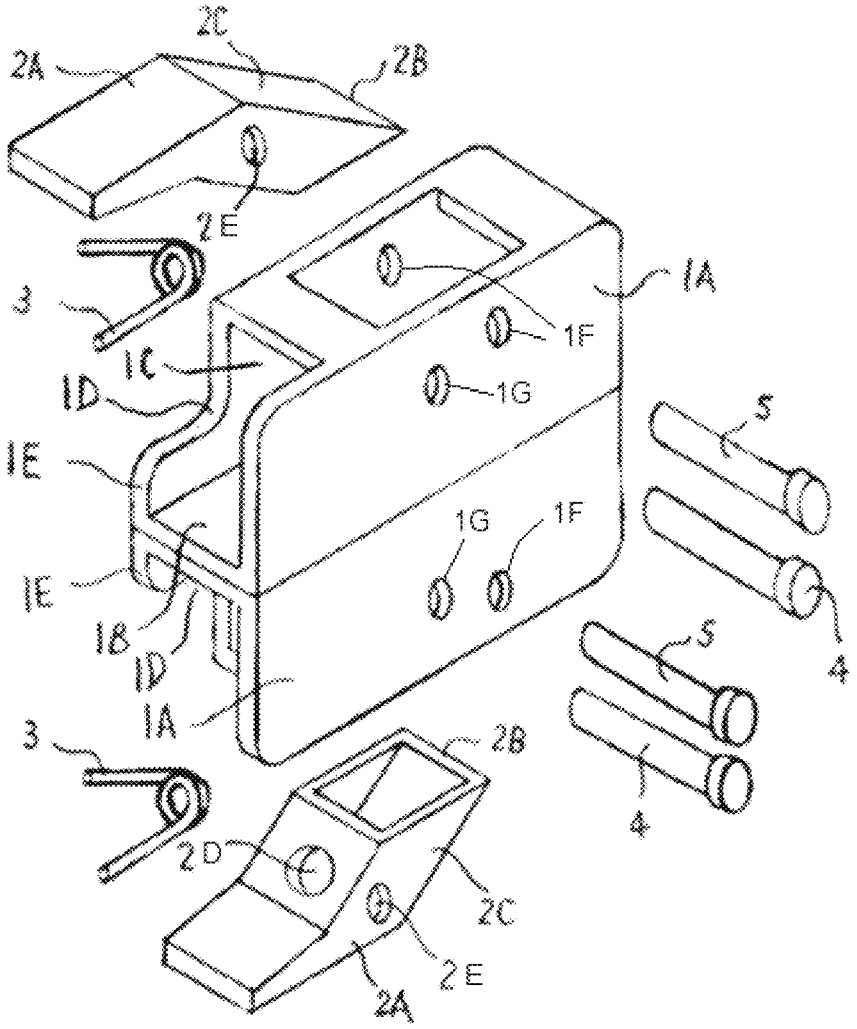
FIG. 7 shows a blow up 3D isometric drawing the parts of an embodiment of a disassembled pair of rear spring support LRDs which can be attached to one another in a parallel configuration as a "Ratchet Buckle". The parts' orientations correspond to their actual orientations in the assembled LRDs.

FIG. 7 shows a blow up 3D isometric drawing of the parts of an embodiment of a disassembled pair of rear spring support LRDs which can be attached to one another in a parallel configuration. The parts' orientations correspond to their actual orientations in the assembled LRD. Pins 5, which are riveted to the LRD housing 1A at holes 1F serve as axles for the turning Gates 2C. The turning gates 2C are shown with their sharp front ends 2B and their levers 2A. Holes 2E which serve as turning gates' 2C bearings for axles 5 is not denoted in FIGS. 5 and 6 to avoid overcrowding. Openings 2D which serve as passages for the springs' 3 first wire ends in the rotating gates, are shown in FIGS. 5, 6, 7. Rear support for the spring 3 is provided by pins 4 which are riveted to the LRD housings 1A through holes 1G.

Figure 8:
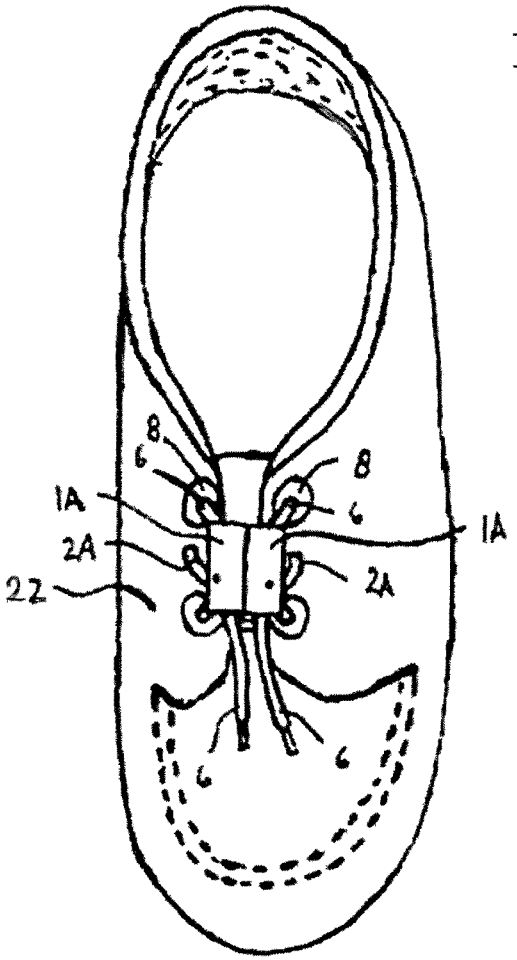
FIG. 8 illustrates a parallel configuration of two rear spring support embodiments of two LRDs, which are used to fasten two shoe laces serving as a shoe ratchet buckle.

FIG. 8 illustrates how a parallel configuration of two LRDs 1A can be used to fasten two shoe laces serving as a shoe ratchet buckle. Laces 6 which exit from eyelets 8 of the shoe's top 22, enter the parallel configuration of two LRDs 1A and can be fastened simply by pulling forwards at the laces' ends. The fastened laces 6 can be released by pressing simultaneously on opposite levers 2A.

Figure 9:
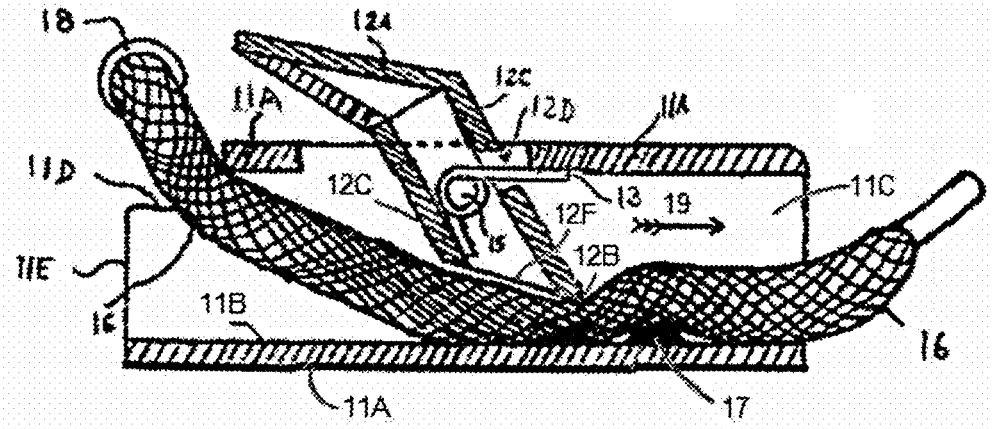
FIGS. 9 and 10 illustrate projections of cross sections of a front spring support embodiment of a LRD with its ratcheting mechanism in active and inactive positions respectively.
Figure 10:
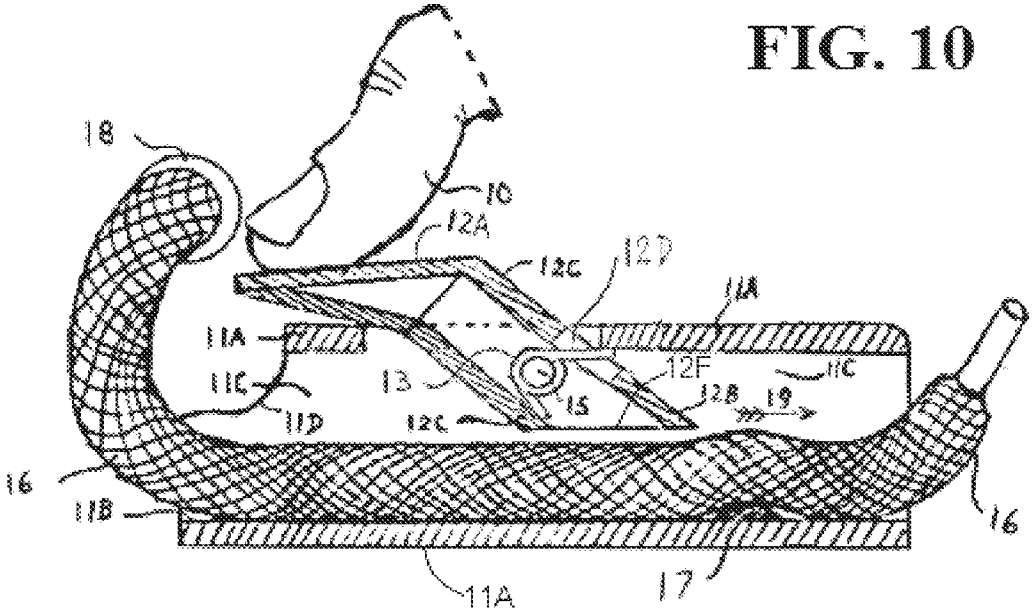

FIGS. 9 and 10 illustrate projections of cross sections of an embodiment of a front spring support LRD with ratcheting mechanisms in active and inactive positions respectively. The LRD's housing 11A provides the walls for the channel 11C which houses the turning Gate 12C which is installed on an axle 15. The channel 11C also houses the lace 16. The turning Gate 12C in FIG. 9 which is in an active position squeezes the lace 16 in the Gap between the Gate's sharp front end 12B and the channel's gripping wall 11B. In FIG. 10 the turning Gate 12C is in inactive position because the Gate 12C is rotated in counterclockwise direction (also called turning forwards direction) and the Gap between the Gate's sharp edge at the front end 12B and its gripping wall 11B is wider than the width of lace 16. As shown in FIG. 10, the user has been switching the ratcheting mechanism into an inactive position. This is being done by rotating forwards the turning Gate 12C into an inactive position by pressing downwards on the lever 12A with the user's finger 10. As can be observed in FIG. 9, the turning Gate 12C is in a forward leaning diagonal orientation. In this orientation pulling the lace 16 in forwards direction (to the right) which is denoted by the arrow 19, causes the Gate's front end 12B to move in a combined forwards and laterally inwards motion (i.e. moving upwards and away from the gripping wall 11B) motion. The lateral inwards movement increases the width of the Gap and also turns the sharp front end 12B away from the lace 16, thus allowing the lace to move forwards more easily with less friction and wear because the lace 16 slides on the gate's smooth side 12F and on the smoothed gripping wall 12B. On the other hand, pulling the lace 16 in backwards direction (to the left) which is opposite to the arrow 19, causes the turning Gate's front end 12B to move in a combined backwards and laterally outwards motion (i.e. moving towards the gripping wall 11B). The laterally outwards movement reduces the width of the Gap, thus squeezing the lace even harder therefore preventing the lace to move further backwards. The bulge 17 which is installed on the gripping wall 11B, increases the b force of the turning Gate 12C even further by forcing the lace to bend when the sharp front end 12B squeezes it. Both the gripping wall 11B and the bulge 17 have smooth surfaces to minimize the wear of the lace passing in the gap.

The spring 13 which is installed on the axle 15 is preloaded and has a bias which constantly pushes the turning Gate 11C to turn backwards (i.e. in clockwise direction in FIG. 9). Thus, the spring 13 keeps the LRD in an active position when the user is not pressing on the lever 12A. To switch the Gate's ratcheting mechanism into an inactive position, the user 10 has to press the Gate's lever 12A downwards overcoming the spring's 13 bias. In FIG. 9 the lace 16 exits the shoe's eyelet 18 and enters the channel 11C. The lace 16 in FIG. 9 is fastened and enters the channel 11C via the recess 11D. The downwards pressure of the fastened lace 16 on the recess 11D in the lower side wall and the upwards counter pressure of the shoe on the channel's rear segment 11E of the lower side wall create a moment of force which forces the LRD to rotate downwards, thus keeping the LRD flat on the shoe.

Figure 11:
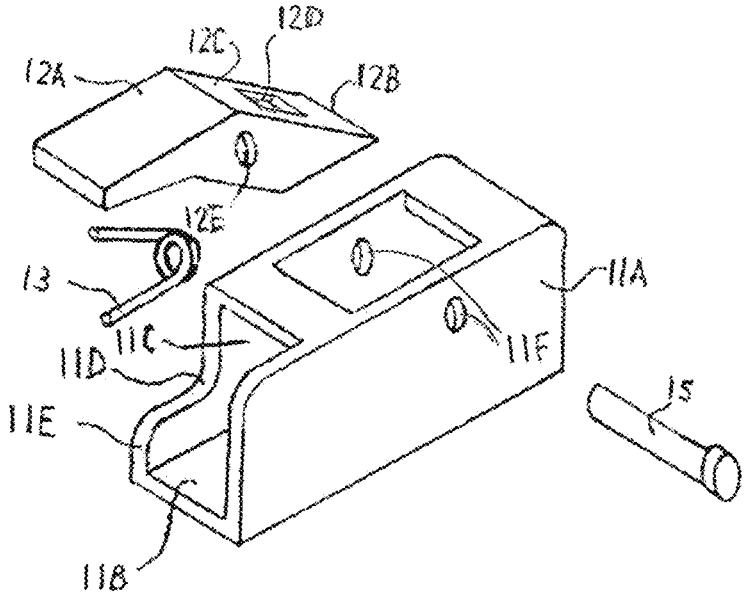
FIG. 11 shows a blow up 3D isometric drawing the parts of a front spring support embodiment of a disassembled LRD. The parts' orientations correspond to their actual orientations in the assembled LRD.

FIG. 11 shows a blow up 3D isometric drawing of the parts of an embodiment of a disassembled front support LRD. The parts' orientations correspond to their actual orientations in the assembled LRD. Pin 15 serves as an axle to the Gate 12C is riveted to holes 11F in the LRD cannel's housing 11A. The turning gate 12C is shown with its sharp front end 12B and its lever 12A. Hole 12E which serve as a bearing for axle 15 is illustrated in FIG. 11 but is not explicitly denoted in FIGS. 9 and 10 to prevent overcrowding. Opening 12D which serves as a passage for the helical torque spring's 13 first wire end in the rotating gate, is shown in FIGS. 9, 10, 11.

Figure 12:
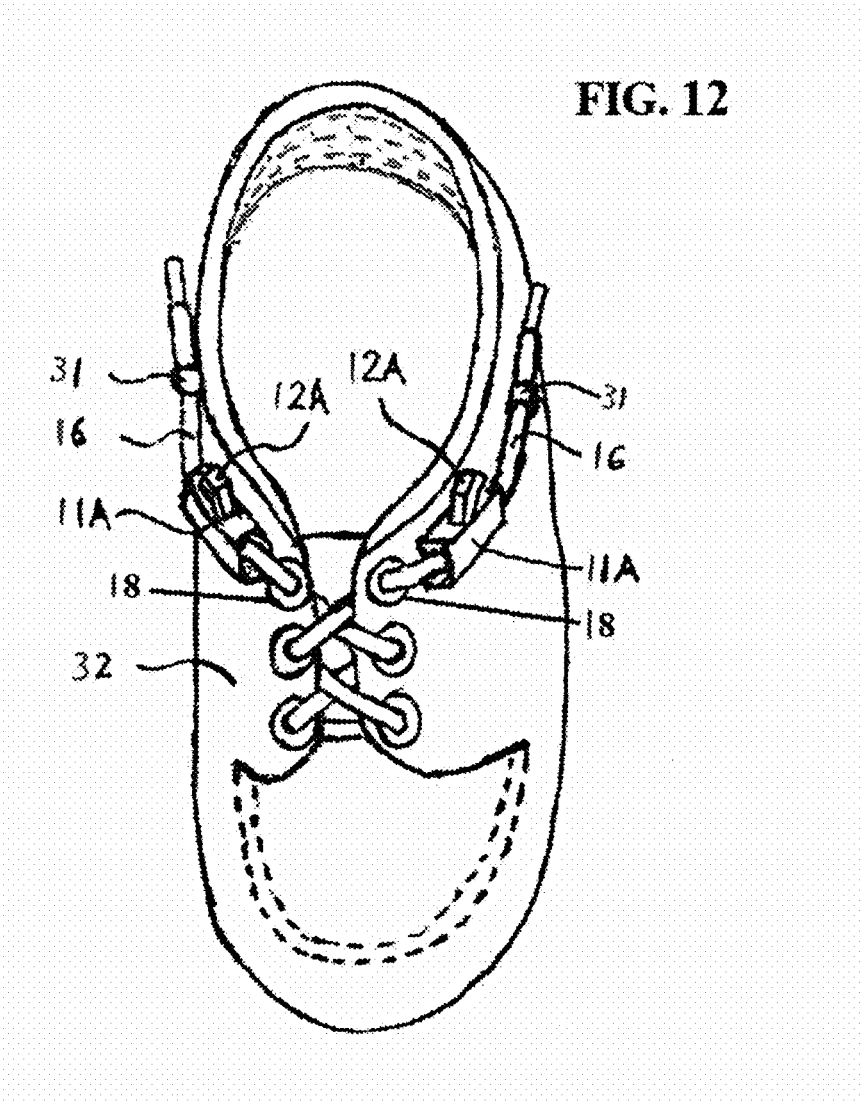
FIG. 12 describes two front spring support embodiments of the LRD, which are installed on two sides of a shoe for lace fastening arrangement.

FIG. 12 describes two LRDs 11A which are installed on a shoe's top 32. The laces 16 which exit the eyelets 18, enter the LRDs 11A and are fastened backwards. The hooks 31 serve as lace end holders to prevent lace dangling.

Figure 13:
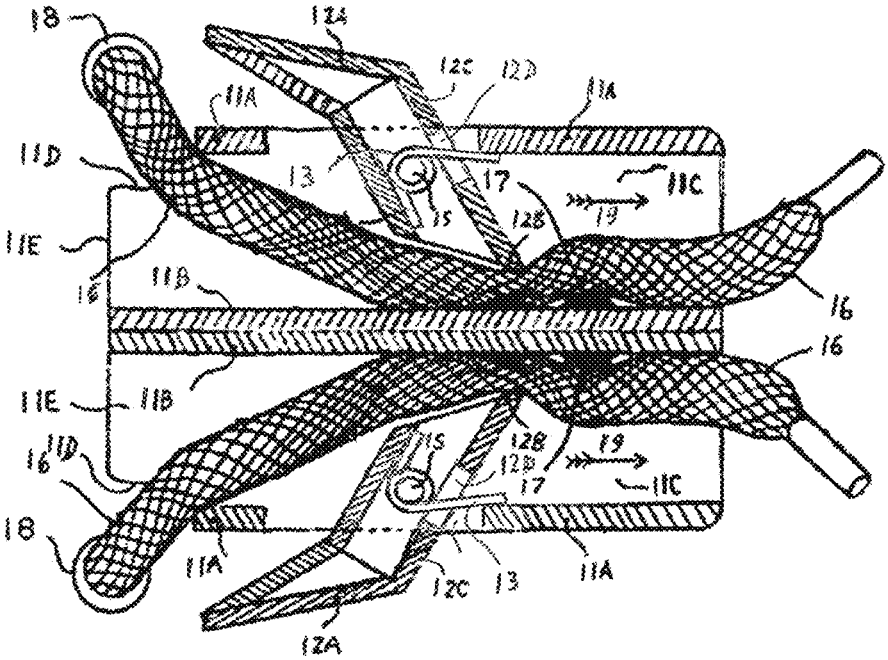
FIG. 13 shows a cross section projection drawing of a pair of front spring support LRFDs which are attached to one another in a parallel configuration as a "Ratchet Buckle". The ratcheting mechanisms of the LRDs in FIG. 13 are in active position.
Figure 14:
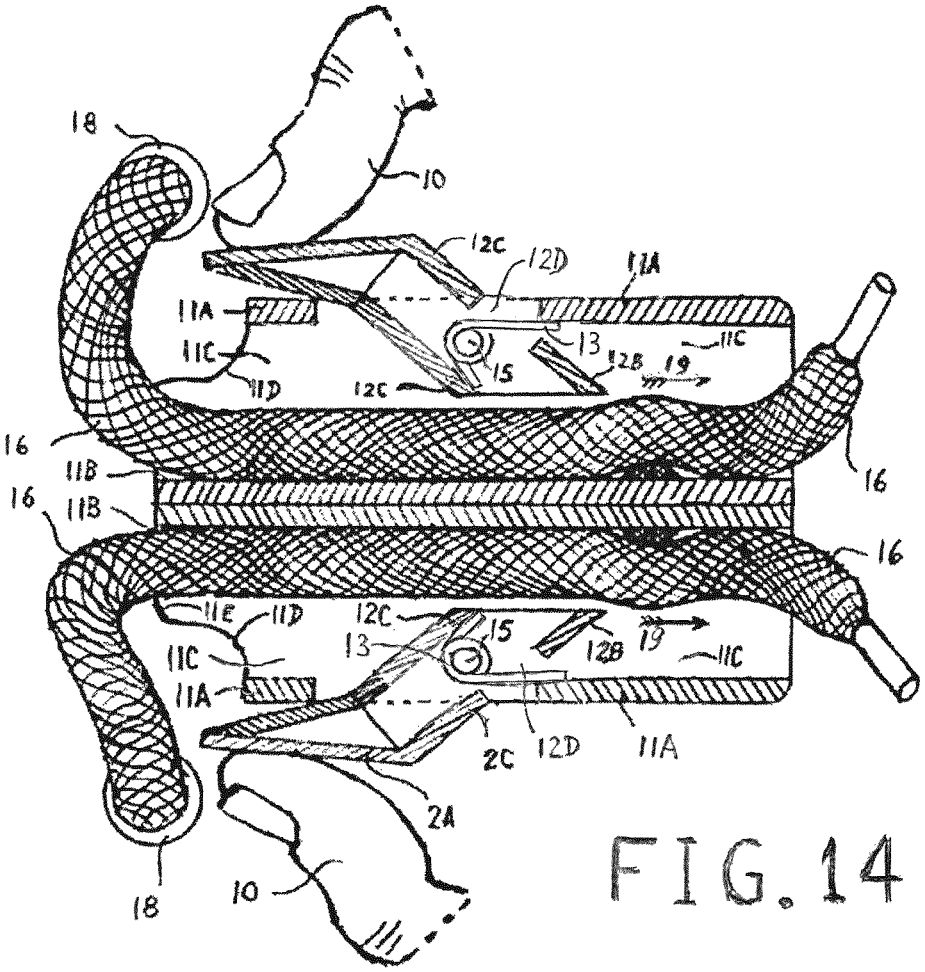
FIG. 14 shows a cross section projection drawing of a pair of front spring support LRDs which are attached to one another in a parallel configuration as a "Ratchet Buckle". The ratcheting mechanisms of the LRDs in FIG. 14 are in inactive position.

FIG. 13 depicts a cross section drawing of a pair of front spring support LRDs which are attached to one another in a parallel configuration. The ratcheting mechanisms of these LRDs are in active positions and the laces 16 are fastened. The LRDs' housing 11A provides the walls for the channels 11C which house the turning Gates 12C that are installed on axles 15. Each of the channels 11C also house a lace 16. The turning Gates 12C in FIG. 13 which are in active positions squeeze the laces 16 in the Gaps between the turning Gates' sharp front ends 12B and the channels' gripping walls 11B. In FIG. 14 the turning Gates 12C are in inactive positions because the turning Gates 12C are rotated in forwards direction and the Gap between the Gates' sharp edges at their front ends 12B and their gripping walls 11B is wider than the widths of laces 16. As shown in FIG. 14, the user has been switching the ratcheting mechanism into inactive positions. This is being done by rotating forwards the turning Gates 12C into inactive positions by pressing on the levers 12A (which protrude from the top LRD walls) with two of the users' fingers 10. As can be observed in FIG. 13, the turning Gates 12C are in a forward leaning diagonal orientations. In these orientations pulling the laces 16 in forwards direction (to the right) which is denoted by the arrows 19, causes the Gates' front end to move in a combined forwards and laterally inwards motion (i.e. moving away from their gripping walls 116). The lateral inwards movements increase the widths of the Gaps and also turns the sharp front ends 12B away from the laces 16, thus allowing the laces to move forwards more easily with less friction and the laces slide on the smooth sides 12F of the front ends 12B and on the smoothed gripping walls 11B with minimal wear. On the other hand, pulling the laces 16 in backwards directions (to the left) which is opposite to the arrows 19, causes the turning Gates' front ends to move in a combined backwards and laterally outwards motions (i.e.

moving towards the gripping walls 11B). The laterally outwards movements reduce the widths of the Gaps, thus squeezing the laces even harder therefore preventing the laces to move further backwards. The bulges 17 which are installed on the gripping walls 11B, increase the b force of the turning Gates 12C even further by forcing the laces to bend when the front ends 126 squeezes them. Both the gripping walls 11B and the bulges 17 have smooth surfaces to minimize the wear of the lace passing in the gap.

In FIGS. 13 and 14 the springs 13 which are installed on the axles 15 are preloaded and have a bias which constantly pushes the turning Gates 11C to turn backwards. Thus, the springs 13 keep the LRDs in an active position when the user is not pressing on the gate levers 12A. To switch the Gates' ratcheting mechanisms into inactive positions, the user 10 has to press the levers 12A overcoming the springs' 13 biases—as shown in FIG. 14. In FIG. 13 the laces 16 exit the shoe's eyelets 18 and enter the channels 11C. The laces 16 in FIG. 13 are fastened and enter the channels 11C via the recesses 11D in the lower side walls which are situated at the lower side walls of the entrances of the channels 11C. The downwards pressure of the fastened laces 16 on the recesses 11D create as a reaction an equal counter upwards pressure of the shoe on the channels' entrance rear segments 11E. The downwards pressure coupled with the upwards pressure generate a rotating moment force which tends to press the bottom part of the LRDs parallel configuration against the top part of the shoe. Whereby, keeping the LRDs parallel configuration pressed flat on top of the shoe.

Figure 15:
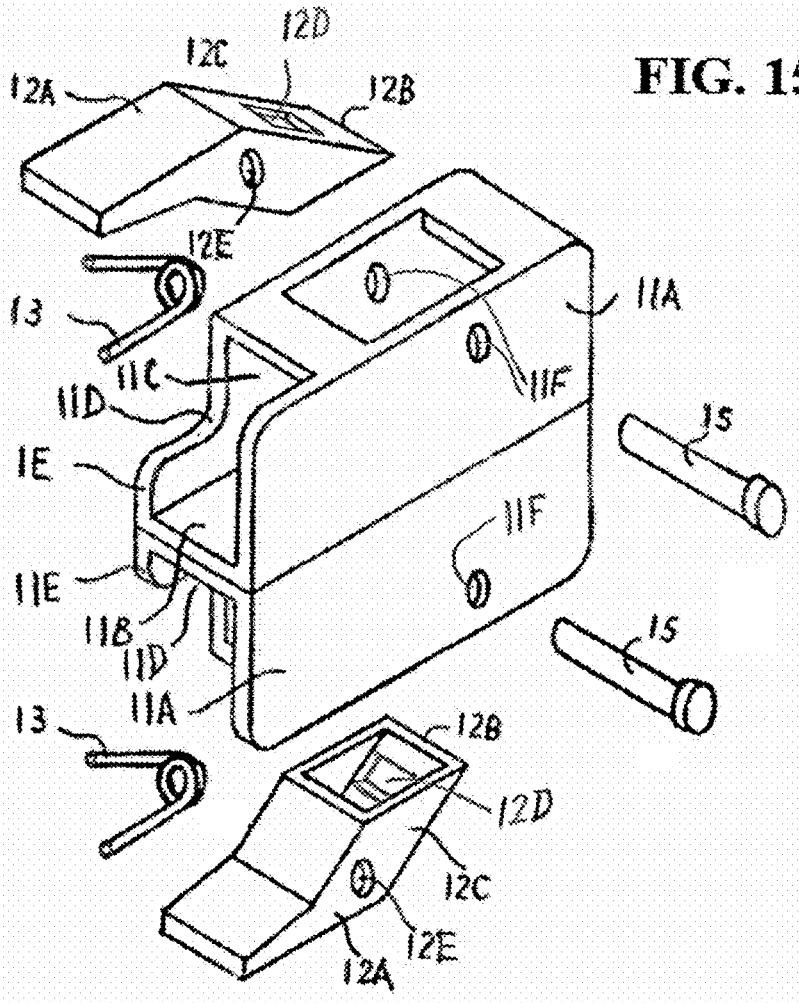
FIG. 15 shows a blow up 3D isometric drawing the parts of an embodiment of a disassembled pair of front spring support LRDs which can be attached to one another in a parallel configuration as a "Ratchet Buckle". The parts' orientations correspond to their actual orientations in the assembled LRDs.

FIG. 15 shows a blow up 3D isometric drawing of the parts of an embodiment of a disassembled pair of front spring support LRDs which can be attached to one another in a parallel configuration. The parts' orientations correspond to their actual orientations in the assembled LRD. Pins 15 serve as axles to the turning Gates 12C. The turning gates 12C are shown with their sharp front ends 12B and their levers 12A. Holes 12E which serve as a bearings for axles 15 are illustrated in FIG. 15 but are not explicitly denoted in FIGS. 13 and 14 to avoid overcrowding. The pins 15 are riveted into holes 11F in the LRD housings 11A. Openings 12D which serve as passages for the springs' 13 first wire ends in the rotating gates, are shown in FIGS. 13, 14, 15.

Figure 16:
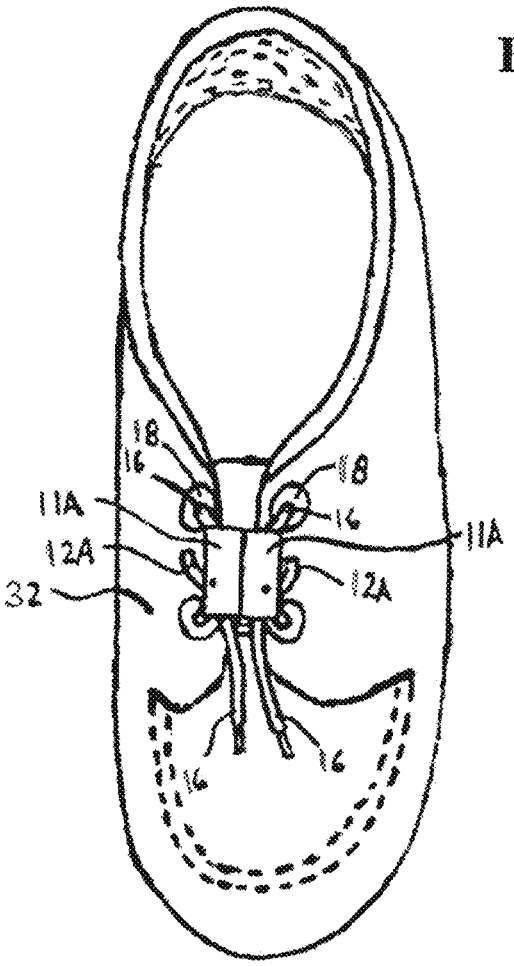
FIG. 16 illustrates a parallel configuration of two front spring support embodiments of two LRDs which are used to fasten two shoe laces serving as a shoe ratchet buckle.

FIG. 16 illustrates how a parallel configuration of two LRFDs 11A can be used to fasten two shoe laces serving as a shoe ratchet buckle. Laces 16 which exit from eyelets 18 of the shoe's top 32, enter the parallel configuration of two LRDs 11A and can be fastened simply by pulling forwards at the laces' 16 ends. The fastened laces 16 can be released by pressing simultaneously on opposite protruding levers 12A.

Figure 17:
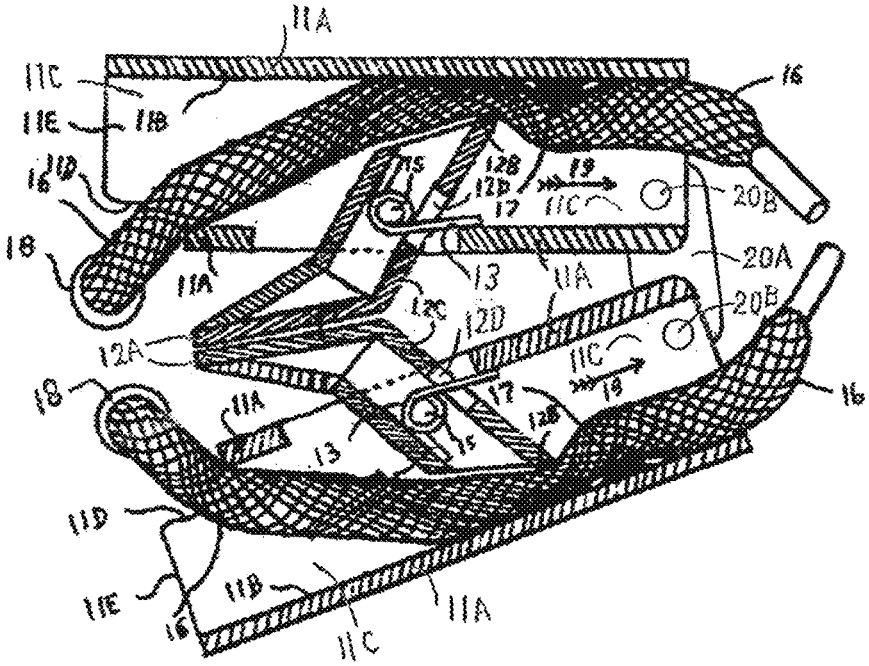
FIG. 17 shows a cross section projection drawing of a pair of front spring support LRFDs which are attached to one another in a triangular configuration as a "Ratchet Buckle". The ratcheting mechanisms of the LRDs in FIG. 17 are in active position.
Figure 18:
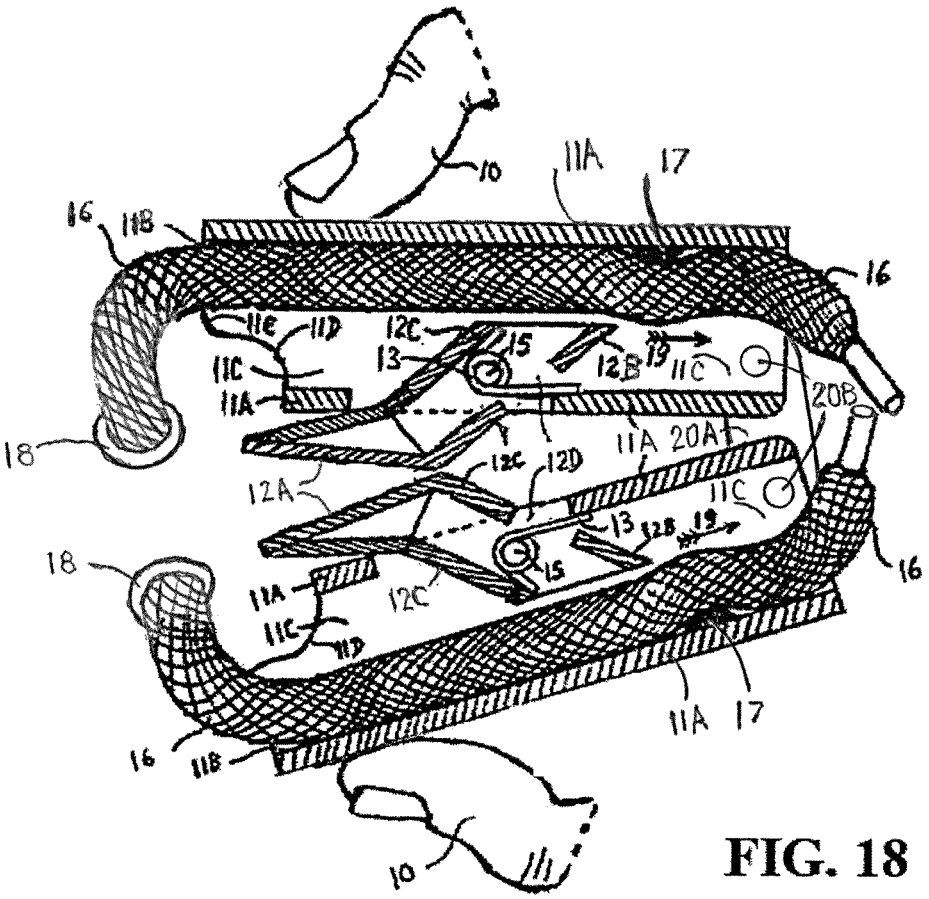
FIG. 18 shows a cross section projection drawing of a pair of front spring support LRFDs which are attached to one another in a triangular configuration as a "Ratchet Buckle". The ratcheting mechanisms of the LRDs in FIG. 18 are in inactive position.

To eliminate the protruding gate levers, two LRDs can be installed in a triangular configuration. The triangular configuration of front spring support LRDs is illustrated in FIGS. 17-20. The two channel's gripping walls 11B form the two sides of a narrow triangle while the two levers 12A are facing one another between the channels at the triangle's center. The two channels' 11C housings 11A are hinged by two hinges 20B to a connecting plate 20A and can turn one with respect to the other. A cross section drawing of the triangular configuration LRD in active position is presented in FIG. 17. The triangular configuration LRDs in FIGS. 17-20 have springs 13 with front supports, i.e. the first wire ends of the helical torque springs 13 are supported by the top wall. In the active position the triangular configuration LRDs have a triangle base which is wider than the base in inactive position since the two gate levers 12A, which are facing one another are protruding more from the channels 11C because the LRDs are in active position. The gate levers 12A in FIG. 18 are compressed, which is described by a cross section of the triangular configuration LRD in inactive position. The user (as shown in FIG. 18) can inactivate both LRDs easily by pressing on both sides of the triangular configuration i.e. on the channels' gripping walls 11B with two fingers 10 of one hand. The pressure causes the channels 11C to rotate one towards the other on hinges 20 and at the same time to press the gate levers 12A which are facing one another. When the gate levers 12A are pressed the turning gates 12C turn forwards on their axles 15 and cause their sharp edges at their front ends 12B to move laterally inwards (i.e. away from their gripping walls 11B) in their respective channels. The front ends 12B motion increases the gaps between the gates' front ends 12B and their gripping walls 11B, which inactivates the ratcheting mechanisms of the LRDs and allows the laces 16 to move freely in their respective channels.

Figure 19:
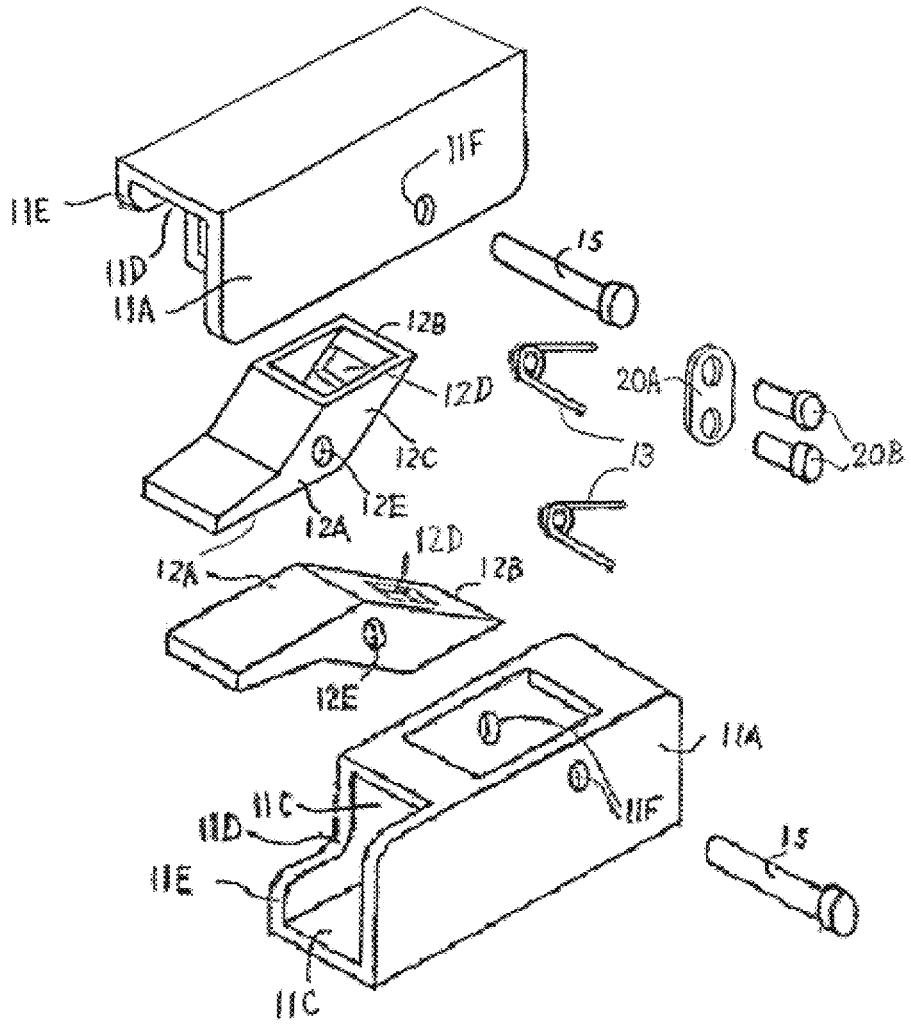
FIG. 19 shows a blow up 3D isometric drawing the parts of an embodiment of a disassembled pair of front spring support LRFDs which can be attached to one another in a triangular configuration as a "Ratchet Buckle". The parts' orientations correspond to their actual orientations in the assembled LRDs.

FIG. 19 illustrates a blow up 3D isometric drawing of the parts of an embodiment of a disassembled pair of front spring support LRDs which can be attached to one another in a triangular configuration. The parts' orientations correspond to their actual orientations in the assembled LRD. Pins 15 serve as axles to the turning Gates 12C. The turning gates 12C are shown with their sharp front ends 12B and their levers 12A. Holes 12E which serve as a bearings for axles 15 are illustrated in FIG. 19 but are not denoted explicitly in FIGS. 17 and 18 to avoid overcrowding. The pins 15 are riveted into holes 11F in the LRD housings 11A. Openings 12D which serve as passages for the springs' 13 first wire ends in the rotating gates 12C, are shown in FIGS. 17, 18, 19. The two channels' housings 11A are hinged to one another by the two hinges 20B which are riveted to the connecting plate 20A.

The triangular configuration has the advantage that it has better outlined shape since it does not have protruding gate levers on both sides. Both the structures of the parallel configuration and triangular configuration of two LRDs is designed to lie flat on top of the shoe when the laces are fastened. This is achieved by entering the laces via recesses 11D in the lower side walls of the LRD channels. The downwards pressure of the laces when fastened on the recesses 11D and the equal upwards pressure which is generated as an equal reaction to the downwards pressure, is applied on the channels rear segments 11E, and create a rotation moment force which forces the lower side wall of the LRDs to lie flat on the top side of the shoe.

Figure 20:
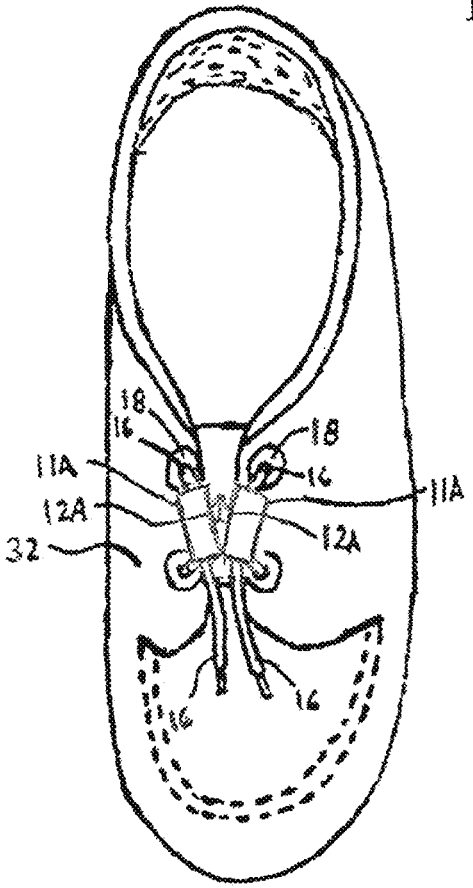
FIG. 20 illustrates a triangular configuration of two front spring support embodiments of LRDs, which are used to fasten two shoe laces serving as a shoe ratchet buckle.

FIG. 20 illustrates how a triangular configuration of two front spring support LRDs 11A can be used to fasten two shoe laces serving as a shoe ratchet buckle. Laces 16 which exit from eyelets 18 of the shoe's top 32, enter the triangular configuration of two LRDs 11A and can be fastened simply by pulling forwards at the laces' ends. The fastened laces 16 can be released by pressing simultaneously on opposite channel sides 11A.

Figure 21:
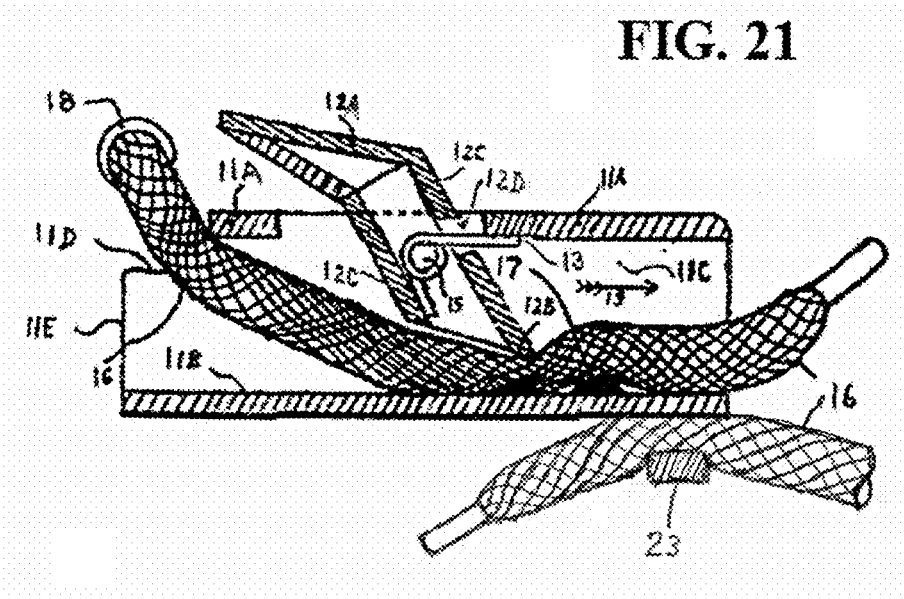
FIGS. 21 and 22 illustrate projections of cross sections of a front spring support embodiments of a LRD for a single lace fastening with their ratcheting mechanisms in active and inactive positions respectively. Such LRDs could be used to fasten laces in clothing articles, etc.
Figure 22:
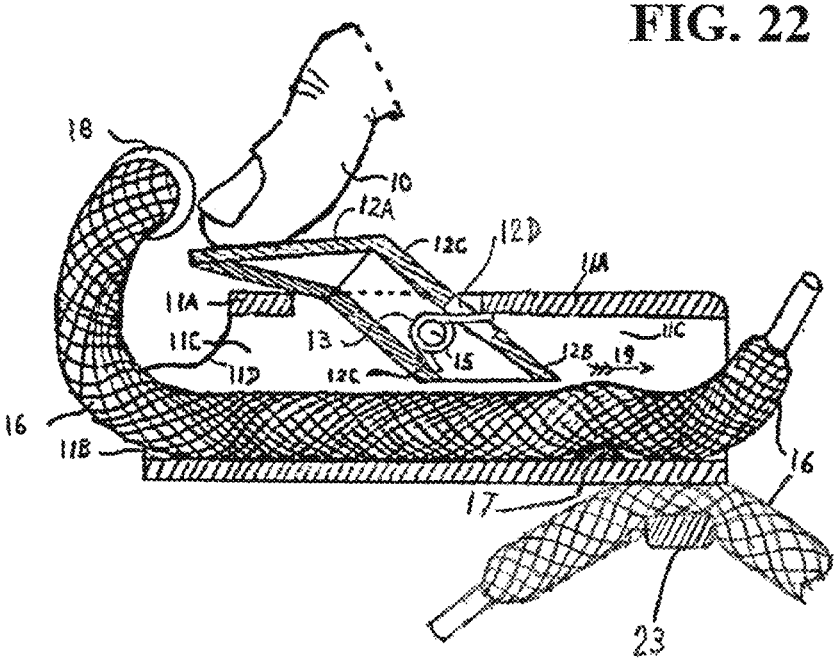

FIGS. 21 and 22 depict a single front spring support LRD which can be used to fasten laces of trousers, coats or other objects simply by tying one lace end to the LRD and using the LRD to fasten the other lace's end. Such a LRD is illustrated in FIGS. 21 and 22 by cross sections of an embodiment of a front spring support LRD with ratcheting mechanisms in active and inactive positions respectively. The LRD's housing 11A provides the walls for the channel 11C which houses the turning Gate 12C which is installed on an axle 15. The channel 11C also houses the lace 16. The turning Gate 12C in FIG. 21 which is in an active position squeezes the lace 16 in the Gap between the Gate's front end 12B and the channel's gripping wall 11B. In FIG. 22 the turning Gate 12C is in inactive position because the Gate 12C is rotated in counterclockwise direction (also called forwards direction) and the Gap between the Gate's sharp front end 12B and its gripping wall 11B is wider than the width of lace 16. As shown in FIG. 22, the user has been switching the ratcheting mechanism into an inactive position. This is being done by rotating forwards the turning Gate 12C into an inactive position by pressing downwards on the lever 12A with the user's finger 10.

As can be observed in FIG. 21, the turning Gate 12C is in a forward leaning diagonal orientation. In this orientation pulling the lace 16 in forwards direction (to the right) which is denoted by the arrow 19, drags the Gate's front end 12B due to front end—lace mutual friction and forces it to move in a combined forwards and laterally inwards motion (i.e. moving upwards and away from the gripping wall 11B) motion. The lateral inwards movement increases the width of the Gap and also turns the sharp front end 12B away from the lace 16, thus allowing the lace to move forwards more easily with less friction and wear. On the other hand, pulling the lace 16 in backwards direction (to the left) which is opposite to the arrow 19, drags the turning Gate's front end 12B and forces it to move in a combined backwards and laterally outwards motion (i.e. moving towards the gripping wall 11B). The laterally outwards movement reduces the width of the Gap, thus squeezing the lace even harder therefore preventing the lace to move further backwards. The bulge 17 which is installed on the gripping wall 11B, increases the b force of the turning Gate 12C even further by forcing the lace to bend when the front end 12B squeezes it. Both the gripping wall 11B and the bulge 17 have smooth surfaces to minimize the wear of the lace passing in the gap.

The helical torque spring 13 which is installed on the axle 15 is preloaded and has a bias which constantly pushes the turning Gate 11C to turn backwards (i.e. in clockwise direction in FIG. 21). Thus, the spring 13 keeps the LRD in an active position when the user is not pressing on the lever 12A. To switch the Gate's ratcheting mechanism into an inactive position, the user 10 has to press the Gate's lever 12A downwards overcoming the spring's 13 bias. In FIG. 21 the lace 16 exits the garment's eyelet 18 and enters the channel 11C. The lace 16 in FIG. 21 is fastened and enters the channel 11C via the recess 11D in the lower side wall. The downwards pressure of the fastened lace 16 on the recess 11D and the upwards counter pressure of the garment on the lower side wall's rear segment 11E create a moment force which forces the LRD to rotate downwards, thus keeping the LRD flat on the garment. The garment LRD is tied to the second end of the lace 16 by the pressing ring 23. Thus, fastening force of the lace 16 end on the LRD towards the left is countered by the force towards the right exerted by the other lace's end, which is attached to the LRD by the ring 23.

Figure 23:
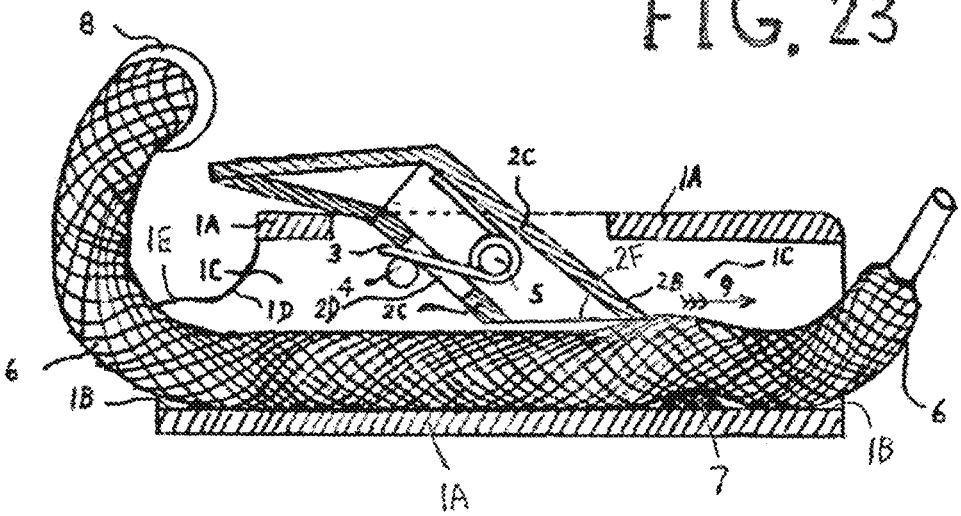
FIGS. 23 and 24 depict the lace sliding operation on the smooth sides of the front ends of gates of the LRDs while fastened.
Figure 24:
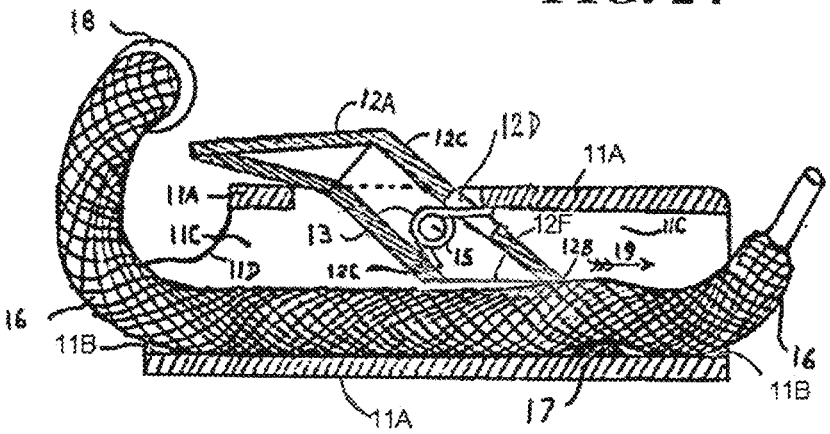

FIGS. 23 and 24 depict the lace sliding operation on the smooth sides of the front ends of gates of rear and front spring support LRDs respectively, while fastened. FIGS. 23 and 24 show the sliding on the smooth sides of the front ends of gates of LRDs with rear and front spring support respectively. Referring to FIG. 23, when lace 6 is fastened it drags the front end 2B of the turning gate 2C forwards (i.e. towards the right—arrow 9). This turns the gate 2C forwards and the lace which was squeezed in the gap by the sharp end of the front end 2B is now in touch with the sharp edge's smooth side 2F. This enables it to slide on the smooth side 2F with minimal wear. The other side of the lace 6 is touching the smooth surface of the gripping wall 1B which also does not wear the lace 6.

Referring to FIG. 24, (which depicts front spring support LRD) when lace 16 is fastened it drags the front end 12B of the turning gate 12C forwards (i.e. towards the right arrow 19). This turns the gate 12C forwards and the lace which was squeezed in the gap by the sharp end of the front end 12B is now in touch with the sharp edge's smooth side 12F. This enables it to slide on the smooth side 12F with minimal wear. The other side of the lace 16 is touching the smooth surface of the gripping wall 11B which also does not wear the lace 16.

Figure 25:
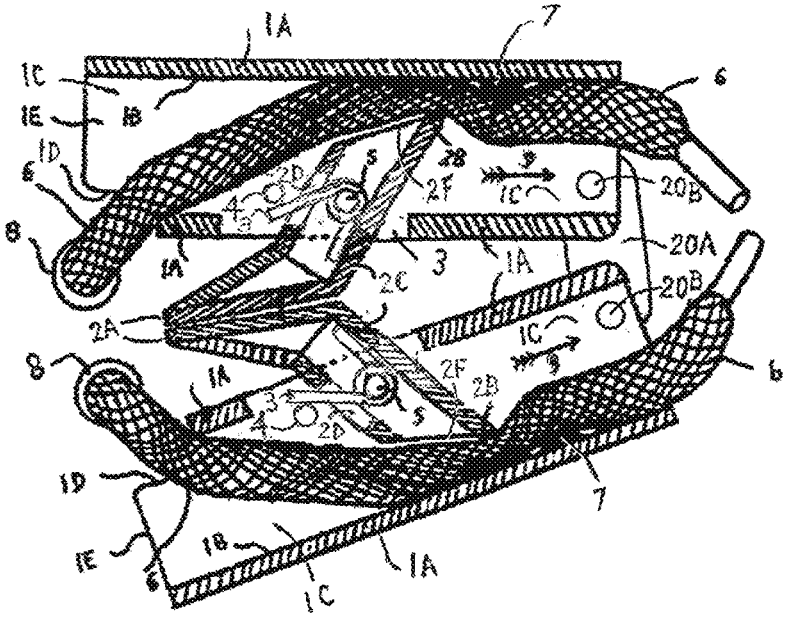
FIG. 25 shows a cross section projection drawing of a pair of rear spring support LRDs which are attached to one another in a triangular configuration as a "Ratchet Buckle". The ratcheting mechanisms of the LRDs in FIG. 25 are in active position.
Figure 26:
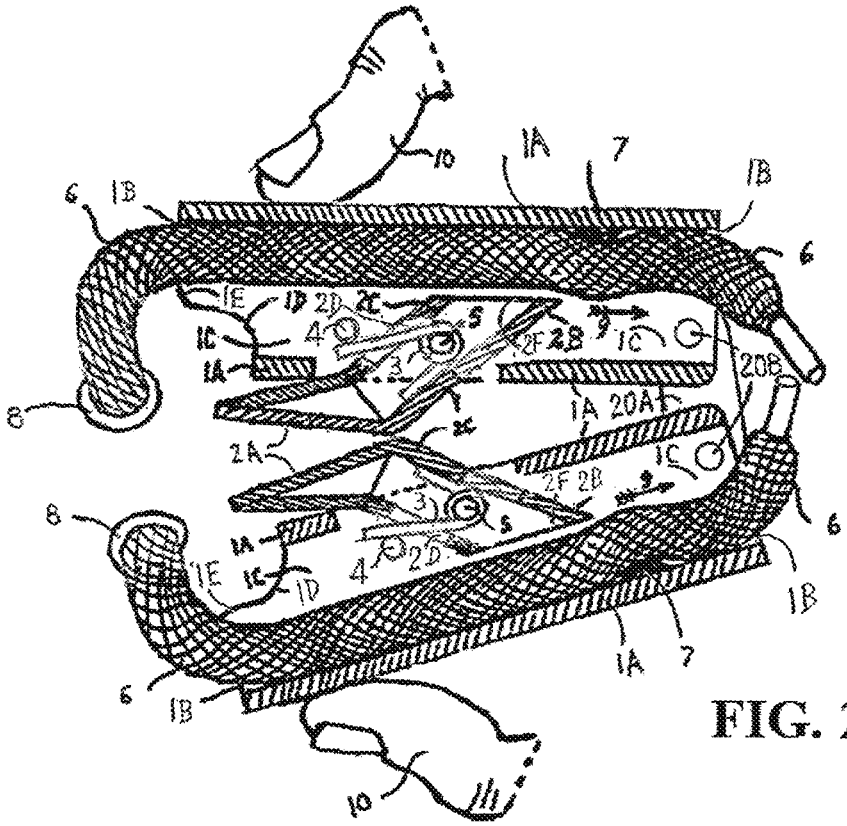
FIG. 26 shows a cross section projection drawing of a pair of rear spring support LRDs which are attached to one another in a triangular configuration as a "Ratchet Buckle". The ratcheting mechanisms of the LRDs in FIG. 26 are in inactive position.
Figure 27:
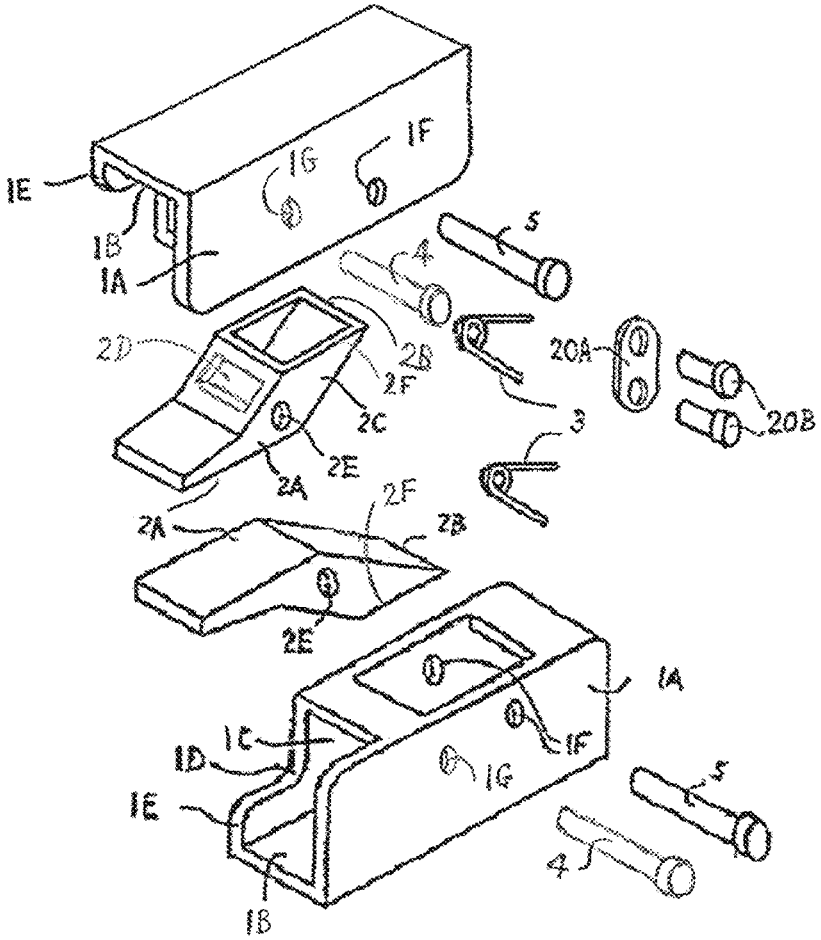
FIG. 27 shows a blow up 3D isometric drawing the parts of an embodiment of a disassembled pair of rear spring support LRDs which can be attached to one another in a triangular configuration as a "Ratchet Buckle". The parts' orientations correspond to their actual orientations in the assembled LRDs.

To eliminate the protruding gate levers, two LRDs can be installed in a triangular configuration. The triangular configuration of rear spring support LRDs is illustrated in FIGS. 25-27. The two channel's gripping walls 1B form the two sides of a narrow triangle while the two levers 2A are facing one another between the channels at the triangle's center. The two channels' 2C housings 2A are hinged by two hinges 20B to a connecting plate 20A and can turn one with respect to the other. A cross section drawing of the triangular configuration LRD in active position is presented in FIG. 25. The triangular configuration LRDs in FIGS. 25-27 have springs 3 with rear supports, i.e. the first wire ends of the helical torque springs 3 are supported by the pin 4. In the active position the triangular configuration LRDs have a triangle base which is wider than the base in inactive position since the two gate levers 2A, which are facing one another are protruding more from the channels 1C because the LRDs are in active position. The gate levers 2A in FIG. 26 are compressed, which is described by a cross section of the triangular configuration LRD in inactive position. The user can inactivate both LRDs easily by pressing on both sides of the triangular configuration i.e. on the channels' gripping walls 1B with two fingers 10 of one hand. The pressure causes the channels 1C to rotate one towards the other and at the same time to press the gate levers 2A which are facing one another. When the gate levers 2A are pressed the turning gates 2C turn forwards on their axles 5 and cause their sharp edges at their front ends 2B to move laterally inwards (i.e. away from their gripping walls 1B) in their respective channels. The front ends 2B motion increases the gaps between the gates' front ends 2B and their gripping walls 1B, which inactivates the LRFDs and allows the laces 6 to move freely in their respective channels.

FIG. 27 illustrates a blow up 3D isometric drawing of the parts of an embodiment of a disassembled pair of rear spring support LRDs which can be attached to one another in a triangular configuration. The parts' orientations correspond to their actual orientations in the assembled LRD. Pins 5 serve as axles to the turning Gates 2C. The turning gates 2C are shown with their sharp front ends 2B and their levers 2A. Holes 2E which serve as a bearings for axles 5 are illustrated in FIG. 27 but are not denoted explicitly in FIGS. 25 and 26 to avoid overcrowding. The pins 5 are riveted into holes 1F in the LRD housings 1A. Openings 2D which serve as passages for the springs' 3 first wire ends in the rotating gates 2C, are shown in FIGS. 25, 26, 27. The two channels' housings 11A are hinged to one another by the two hinges 20B which are riveted to the connecting plate 20A. Pins 4 which provide rear support to the springs 3, are riveted to holes 1G in the channels 1A.

The triangular configuration has the advantage that it has better outlined shape since it does not have protruding gate levers on both sides. Both the structures of the parallel configuration and triangular configuration of two LRDs are designed to lie flat on top of the shoe when the laces are fastened. This is achieved by entering the laces via recesses 1D in the lower side walls of the LRD channels. The downwards pressure of the laces when fastened on the recesses 1D and the equal upwards pressure which is generated as an equal reaction to the downwards pressure, is applied on the lower side wall's rear segments 1E, and create a rotation moment force which forces the bottom side of the LRDs to lie flat on the top side of the shoe.

Figure 28:
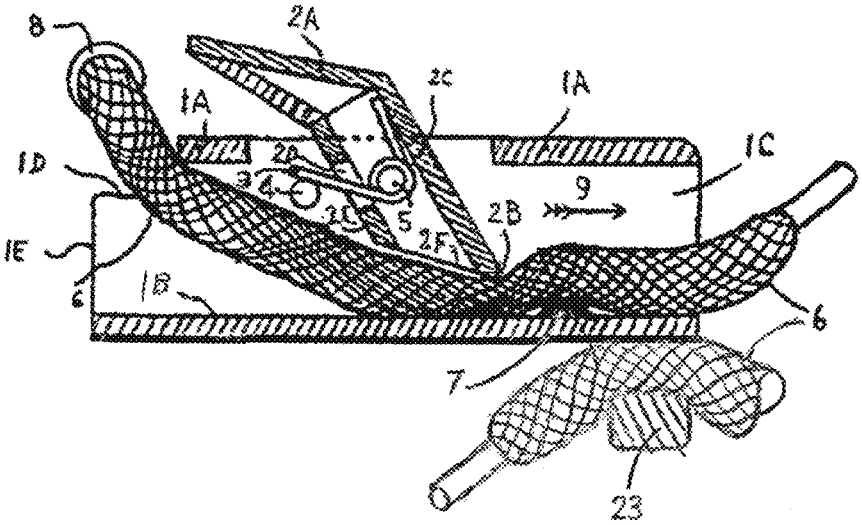
FIGS. 28 and 29 illustrate projections of cross sections of a rear spring support embodiments of a LRD for a single lace fastening with their ratcheting mechanisms in active and inactive positions respectively. Such LRDs could be used to fasten laces in clothing articles, etc.
Figure 29:
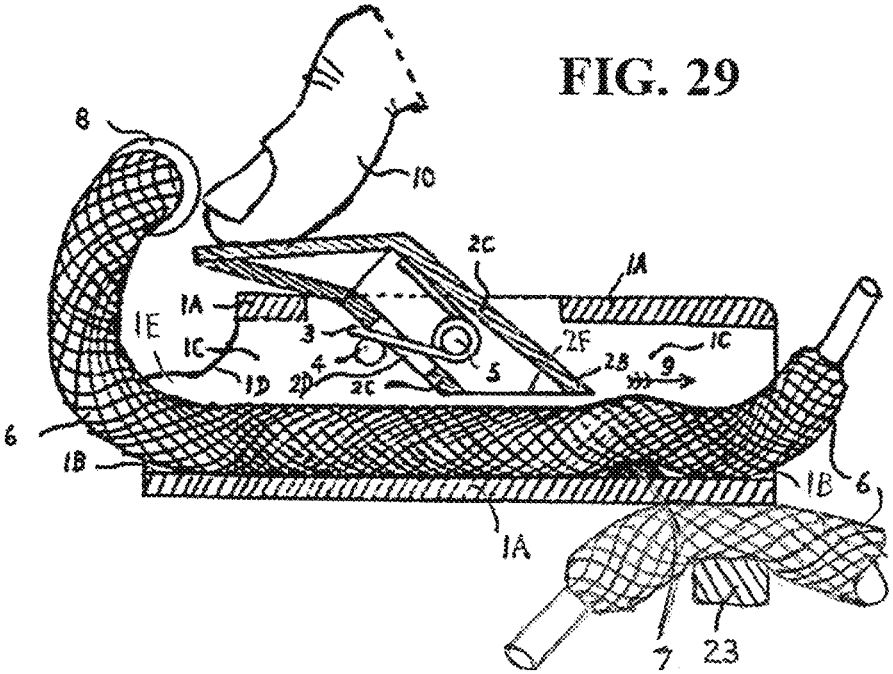

FIGS. 28 and 29 depict a single rear spring support LRD which can be used to fasten laces of trousers, coats or other objects simply by tying one lace end to the LRD and using the LRD to fasten the other lace's end. Such a LRD is illustrated in FIGS. 28 and 29 by cross sections of an embodiment of a rear spring support LRD with ratcheting mechanisms in active and inactive positions respectively. The LRD's housing 1A provides the walls for the channel 1C which houses the turning Gate 2C which is installed on an axle 5. The channel 1C also houses the lace 6. The turning Gate 2C in FIG. 28 which is in an active position squeezes the lace 6 in the Gap between the Gate's front end 2B and the channel's gripping wall 1B. In FIG. 29 the turning Gate 2C is in inactive position because the Gate 2C is rotated in counterclockwise direction (also called forwards direction) and the Gap between the Gate's sharp front end 26 and its gripping wall 1B is wider than the width of lace 6. As shown in FIG. 29, the user has been switching the ratcheting mechanism into an inactive position. This is being done by rotating forwards the turning Gate 2C into an inactive position by pressing downwards on the lever 2A with the user's finger 10.

As can be observed in FIG. 28, the turning Gate 2C is in a forward leaning diagonal orientation. In this orientation pulling the lace 6 in forwards direction (to the right) which is denoted by the arrow 9, drags the Gate's front end 2B due to front end—lace mutual friction and forces it to move in a combined forwards and laterally inwards motion (i.e. moving upwards and away from the gripping wall 1B) motion. The lateral inwards movement increases the width of the Gap and also turns the sharp front end 2B away from the lace 6, thus allowing the lace to move forwards more easily with less friction and wear. On the other hand, pulling the lace 6 in backwards direction (to the left) which is opposite to the arrow 9, drags the turning Gate's front end 26 and forces it to move in a combined backwards and laterally outwards motion (i.e. moving towards the gripping wall 1B). The laterally outwards movement reduces the width of the Gap, thus squeezing the lace even harder therefore preventing the lace to move further backwards. The bulge 7 which is installed on the gripping wall 1B, increases the b force of the turning Gate 2C even further by forcing the lace to bend when the sharp front end 2B squeezes it. Both the gripping wall 1B and the bulge 7 have smooth surfaces to minimize the wear of the lace passing in the gap.

The first wire end of the helical torque spring 3 is supported by the rear pin 4 while the second wire end of the helical torque spring 3 is supported by the gate 2C wall. The helical torque spring 3 which is installed on the axle 15 is preloaded and has a bias which constantly pushes the turning Gate 1C to turn backwards (i.e. in clockwise direction in FIG. 28). Thus, the spring 3 keeps the LRD in an active position when the user is not pressing on the lever 2A. To switch the Gate's ratcheting mechanism into an inactive position, the user 10 has to press the Gate's lever 2A downwards overcoming the spring's 3 bias. In FIG. 28 the lace 6 exits the garment's eyelet 8 and enters the channel 1C. The lace 6 in FIG. 28 is fastened and enters the channel 1C via the recess 1D in the lower side wall. The downwards pressure of the fastened lace 6 on the recess 1D and the upwards counter pressure of the garment on the lower side wall's rear segment 1E create a moment force which forces the LRD to rotate downwards, thus keeping the LRD flat on the garment. The garment LRD is tied to the second end of the lace 6 by the pressing ring 23. Thus, fastening force of the lace 6 end on the LRD towards the left is countered by the force towards the right exerted by the other lace's end, which is attached to the LRD by the ring 23.

Figure 30:
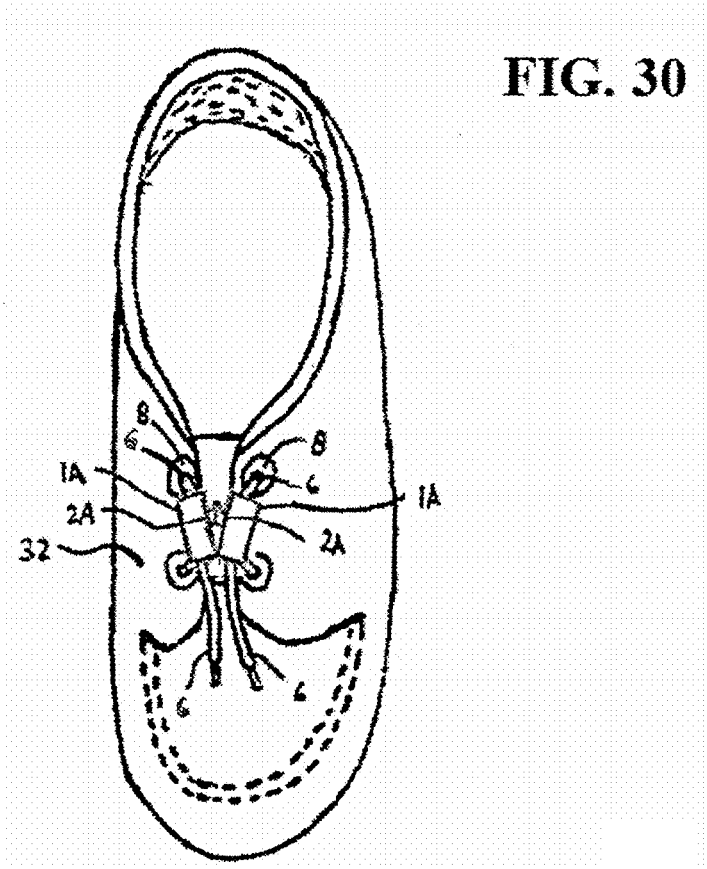
FIG. 30 illustrates a triangular configuration of two rear spring support embodiments of LRDs, which are used to fasten two shoe laces serving as a shoe ratchet buckle.

FIG. 30 illustrates how a triangular configuration of two rear spring support LRDs 1A can be used to fasten two shoe laces serving as a shoe ratchet buckle. Laces 6 which exit from eyelets 8 of the shoe's top 22 enter the triangular configuration of two LRDs 1A and can be fastened simply by pulling forwards at the laces' 6 ends. The fastened laces 6 can be released by pressing simultaneously on opposite channel sides 1A.

The invention claimed is:

1. A ratcheting configuration for fastening of at least one lace by said lace ratcheting; wherein said ratcheting configuration comprising of at least one lace ratcheting device for fastening said lace by said lace ratcheting;

said lace ratcheting device comprises a channel; wherein said channel further comprising: a gripping wall, a top wall, a lower side wall and an upper side wall; wherein said channel further comprising: an entry opening and an exit opening; wherein a forwards direction in said channel is defined as direction from said entry opening to said exit opening; wherein a backwards direction in said channel is defined as direction from said exit opening to said entry opening;

wherein a turning gate is rotatably installed inside said channel; wherein said turning gate is made of solid material; wherein said turning gate comprising a front end and a rear end; wherein said turning gate has an axis of rotation, which is located between said front end and said rear end; wherein said turning gate is rotatably installed inside said channel using an axle which is fitted into a bearing; wherein axis of said axle coincides with said axis of rotation; wherein said gripping wall is positioned opposite to said front end; wherein said top wall is situated opposite to said gripping wall;

wherein a gap exists between said front end and said gripping wall; wherein said gap has a gap width; wherein said turning gate is installed at a predetermined diagonal direction with respect to said forwards direction; wherein at said diagonal direction said front end is closer to said exit opening than said axis of rotation; wherein at said diagonal direction said front end is closer to said gripping wall than said axis of rotation;

wherein a forwards turning is defined as turning of said turning gate in which said front end is moved in a combined said forwards direction plus laterally inwards direction; wherein said laterally inwards direction is directed away from said gripping wall; wherein motion in said laterally inwards direction increases said gap width; thereby, said forwards turning increases said gap width;

wherein a backwards turning is defined as turning of said turning gate in which said front end is moved in a combined said backwards direction plus laterally outwards direction; wherein said laterally outwards direction is directed towards said gripping wall; wherein motion in said laterally outwards direction decreases said gap width; thereby, said backwards turning decreases said gap width;

wherein a forwards motion is defined as motion in said forwards direction; wherein a backwards motion is defined as motion in said backwards direction; wherein a forwards force is a force in said forwards direction; wherein said forwards force applied to said front end is configured to cause said forwards turning; wherein a backwards force is a force in said backwards direction; wherein said backwards force applied to said front end is configured to cause said backwards turning;

wherein said lace ratcheting device has a ratchet mechanism which controls said gap width; wherein said ratchet mechanism has an inactive position and an active position; wherein said lace has a lace width; wherein at said inactive position said gap width is larger than said lace width; thereby, allowing said lace passing through said gap to be moved freely both in said forwards direction and in said backwards direction;

wherein at said active position said gap width is smaller than said lace width; whereby said lace passing through said gap is being squeezed between said front end of said turning gate and said gripping wall; wherein when said ratchet mechanism is in said active position, then moving said lace in said forwards direction also applies said forwards force on said front end due to friction; wherein said forwards force causes said forwards turning of said turning gate; thereby increasing said gap width and allowing easier said forwards motion of said lace; wherein when said ratchet mechanism is in said active position, then moving said lace in said backwards direction applies said backwards force on said front end due to friction; wherein said backwards force causes said backwards turning of said turning gate; thereby further decreasing said gap width and blocking any additional said backwards motion of said lace;

wherein when said ratchet mechanism is in said inactive position, said gap width is larger than said lace width; whereby said lace passing in said gap can be moved freely both in said forwards direction and in said backwards direction; thereby, when said ratchet mechanism is in said active position, said lace ratcheting device is a ratcheting device which enables said forwards motion of said lace for fastening but blocks said backwards motion of said lace;

whereby, when said ratchet mechanism is in said active position, said lace ratcheting device enables said lace fastening and keeps said lace fastened until said ratchet mechanism is switched into said inactive position;

wherein a torque spring has been installed in said channel; said torque spring has a resilient helical wire structure with a first wire end and a second wire end; wherein said torque spring is mounted on said axle; wherein said torque spring is installed preloaded with a bias which tends to cause said backwards turning of said turning gate; wherein, said backwards turning decreases said gap width and squeezes said lace in said gap;

wherein a lever is attached to said rear end; wherein said lever protrudes from an opening in said top wall; wherein said lever facilitates manual switching of said ratcheting mechanism from said active position into said inactive position when a user causes said forwards turning of said turning gate by applying on said lever a manual pressure which is high enough to overcome said bias; thereby, when said user does not apply said manual pressure on said lever and no said forwards force is applied on said front end, said bias is keeping said ratchet mechanism in said active position.

2. The ratcheting configuration of claim 1, wherein said ratcheting configuration comprising of at least one said front end of said turning gate; said front end has a sharp edge which enables said front end to apply concentrated squeezing pressure on said lace when said lace is squeezed; wherein, said sharp edge has a smooth side; wherein said smooth side is opposite to said gripping wall when said turning gate is turned forwards.

3. The ratcheting configuration of claim 1, wherein said ratcheting configuration comprising of at least one said gripping wall; wherein said gripping wall has a smooth surface; whereby, said smooth surface reduces said lace wear when said lace is fastened at said active position and also when said lace is moved freely in said inactive position; In addition, said forwards turning of said turning gate, which occurs at said active position when said lace is being fastened, causes said sharp edge of said front end to turn such that said lace slides on said smooth side of said sharp edge; whereby, further reducing said lace wear due to fastening.

4. The ratcheting configuration of claim 1, wherein said ratcheting configuration comprising of at least one said gripping wall which has a bulge attached to said gripping wall; wherein said bulge causes an additional bending of said lace when said lace is squeezed in said gap between said front end of said turning gate and said gripping wall; whereby, said additional bending increases said lace's motion blocking force when said ratcheting mechanism is in said active position and said lace is pulled in said backwards direction.

5. The ratcheting configuration of claim 1, wherein said ratcheting configuration comprising of at least one said lace ratcheting device with a rear spring support comprising: a rear pin attached to said channel; wherein said first wire end is supported by said rear pin; wherein said second wire end is supported by said turning gate.

6. The ratcheting configuration of claim 1, wherein said ratcheting configuration comprising of at least one said lace ratcheting device with a front spring support comprising: said first wire end supported by said top wall and said second wire end which is supported by said turning gate.

7. The ratcheting configuration of claim 1, wherein said ratcheting configuration comprising of one said lace ratcheting device and one said lace, which has a first lace end and a second lace end; wherein said lace ratcheting device is used for single said lace fastening by tying said first lace end to said lace ratcheting device and fastening said second lace end with said lace ratcheting device; wherein said first lace end pulls in said forwards direction said lace ratcheting device while said lace ratcheting device is being pulled in said backwards direction by said second lace end of fastened said lace.

8. The ratcheting configuration of claim 7, wherein said ratcheting configuration comprising of at least one said lace ratcheting device with a rear spring support comprising: a rear pin attached to said channel; wherein said first wire end is supported by said rear pin; wherein said second wire end is supported by said turning gate.

9. The ratcheting configuration of claim 7, wherein said ratcheting configuration comprising of at least one said lace ratcheting device with a front spring support comprising: said first wire end supported by said top wall and said second wire end which is supported by said turning gate.

10. The ratcheting configuration of claim 1, wherein said ratcheting configuration comprising of two said lace ratcheting devices which are used as a ratchet buckle to fasten two said laces by attaching two said lace ratcheting devices to one another in a parallel configuration; wherein, in said parallel configuration the two said gripping walls of said channels are attached to one another and the two said top walls form two outer sides of said ratchet buckle; wherein said user can fasten two said laces by pulling in said forwards direction two said laces, which were inserted in said channels;

wherein each said top wall has a protruding said lever; whereby, applying said manual pressure on said levers, which is higher than said biases, forces said forwards turning of said turning gates, which in turn inactivates said ratcheting mechanisms and releasing said laces.

11. The ratcheting configuration of claim 10, wherein said ratcheting configuration comprising of at least one said lace ratcheting device with a rear spring support comprising: a rear pin attached to said channel; wherein said first wire end is supported by said rear pin; wherein said second wire end is supported by said turning gate.

12. The ratcheting configuration of claim 10, wherein said ratcheting configuration comprising of at least one said lace ratcheting device with a front spring support comprising: said first wire end supported by said top wall and said second wire end which is supported by said turning gate.

13. The ratcheting configuration of claim 1, wherein said ratcheting configuration comprising of two said lace ratcheting devices in a triangular configuration which are used as said ratchet buckle to fasten two said laces; wherein said triangular configuration is created by rotatably hinging two said lace ratcheting devices on a connecting plate using a hinge for each said lace ratcheting device; wherein in said triangular configuration two said gripping walls of said channels form two sides of a triangle, which are joined at said connecting plate;

wherein two said levers, which are protruding from two said top walls of said channels are facing one another at the center of said triangle; wherein said user can fasten said laces by pulling in said forwards direction two said laces which were inserted in said channels; wherein two said channels in said triangular configuration can be rotated on their said hinges one said channel with respect to the other said channel; whereby, said manual pressure, which exceeds said biases, on one said gripping wall towards the other said gripping wall, causes said channels to move closer and causes said levers to push one another and forces said forwards turning of said turning gates, which in turn inactivates their said ratcheting mechanisms and releasing said laces.

14. The ratcheting configuration of claim 13, wherein said ratcheting configuration comprising of at least one said lace ratcheting device with a rear spring support comprising: a rear pin attached to said channel; wherein said first wire end is supported by said rear pin; wherein said second wire end is supported by said turning gate.

15. The ratcheting configuration of claim 13, wherein said ratcheting configuration comprising of at least one said lace ratcheting device with a front spring support comprising: said first wire end supported by said top wall and said second wire end which is supported by said turning gate.

16. The ratcheting configuration of claim 1, wherein said ratcheting configuration comprising of at least one said lace ratcheting device which can be used to fasten said lace to an object by attaching said lace ratcheting device to said object; wherein said lace can be fastened by pulling said lace in said forwards direction while said ratcheting mechanism is in said active position; said lace can be released by applying on said lever said manual pressure that is higher than said bias, which forces said forwards turning of said turning gate, which in turn inactivates said ratcheting mechanism and releasing said lace.

17. The ratcheting configuration of claim 16, wherein said ratcheting configuration comprising of at least one said lace ratcheting device with a rear spring support comprising: a rear pin attached to said channel; wherein said first wire end is supported by said rear pin; wherein said second wire end is supported by said turning gate.

18. The ratcheting configuration of claim 16, wherein said ratcheting configuration comprising of at least one said lace ratcheting device with a front spring support comprising: said first wire end supported by said top wall and said second wire end which is supported by said turning gate.

19. The ratcheting configuration of claim 10, wherein said ratcheting configuration comprising of at least one said channel at said entry opening which has a recess at said lower side wall; wherein said channel at said entry opening also has a rear segment of said lower side wall situated behind said recess; wherein said lace enters said channel via said recess; wherein when said lace is fastened on a footwear, said lace applies a downwards force on said recess; wherein said downwards force is countered by a reaction upwards force applied on said rear segment by said footwear; said downwards force and said reaction upwards force create a moment of force which tends to rotate said lace ratcheting device towards said footwear; thereby, said moment of force keeps said lace ratcheting device flat on said footwear.

20. The ratcheting configuration of claim 13, wherein said ratcheting configuration comprising of at least one said channel at said entry opening which has a recess at said lower side wall; wherein said channel at said entry opening also has a rear segment of said lower side wall situated behind said recess; wherein said lace enters said channel via said recess; wherein when said lace is fastened on a footwear, said lace applies said downwards force on said recess; wherein said downwards force is countered by said reaction upwards force applied on said rear segment by said footwear; said downwards force and said reaction upwards force create a moment of force which tends to rotate said lace ratcheting device towards said footwear; thereby, said moment of force keeps said lace ratcheting device flat on said footwear.

* * * * *